United States Patent [19]

Spektor

[11] Patent Number: 5,031,706

[45] Date of Patent: Jul. 16, 1991

[54] PNEUMOPERCUSSIVE SOIL PENETRATING MACHINE

[75] Inventor: Michael B. Spektor, Klamath Falls, Oreg.

[73] Assignee: MBS Advanced Engineering Systems, Klamath Falls, Oreg.

[21] Appl. No.: 476,538

[22] Filed: Feb. 7, 1990

[51] Int. Cl.[5] ..... E21B 1/00; E21B 4/14; E21B 7/26

[52] U.S. Cl. ..... 175/19; 175/40; 175/230; 175/296; 173/6; 173/20; 173/91; 173/92; 173/133; 173/139

[58] Field of Search ..... 175/19, 40, 230, 325, 175/203, 296; 173/91, 92, 6, 20, 34, 35, 133, 139, 4, 5

[56] References Cited

U.S. PATENT DOCUMENTS

| | | | |
|---|---|---|---|
| 2,762,341 | 9/1956 | Salengro | 173/139 |
| 3,137,483 | 6/1964 | Zinkiewicz | 262/1 |
| 3,292,976 | 12/1966 | Leavell | 173/139 |
| 3,407,884 | 10/1968 | Zygmunt | 173/91 |
| 3,410,354 | 11/1968 | Sudnishnikov et al. | 173/125 |
| 3,465,834 | 9/1969 | Southworth, Jr. | 173/21 |
| 3,651,874 | 3/1972 | Sudnishnikov et al. | 173/91 |
| 3,708,023 | 1/1973 | Nazarov et al. | 175/19 |
| 3,727,701 | 4/1973 | Sudnishnikov et al. | 173/91 |
| 3,744,576 | 7/1973 | Sudnishnikov et al. | 173/91 |
| 3,756,328 | 9/1973 | Sidnishnikov et al. | 173/91 |
| 3,865,200 | 2/1975 | Schmidt | 175/19 |
| 4,078,619 | 3/1978 | Sudnishnikov et al. | 175/19 |
| 4,100,980 | 7/1978 | Jenne | 175/19 |
| 4,121,672 | 10/1978 | Tkach et al. | 175/19 |
| 4,132,277 | 1/1979 | Tupitsyn et al. | 175/19 |
| 4,214,638 | 7/1980 | Sudnishnikov et al. | 173/1 |
| 4,250,972 | 2/1981 | Schmidt | 173/91 |
| 4,295,533 | 10/1981 | Schmidt | 175/19 |
| 4,596,292 | 6/1986 | Crover | 175/19 |
| 4,662,457 | 5/1987 | Bouplon | 173/91 |
| 4,683,960 | 8/1987 | Kostylev et al. | 173/91 |
| 4,699,223 | 10/1987 | Noren | 173/20 |
| 4,886,128 | 12/1989 | Roemer | 175/19 |
| 4,924,948 | 5/1990 | Chuang et al. | 173/139 |

FOREIGN PATENT DOCUMENTS 505774 3/1976 U.S.S.R. .

800725 9/1958 United Kingdom .

OTHER PUBLICATIONS

Minimum Energy Consumption of Soil Working Cyclic Processes, Journal of Terramechanics, vol. 24, No. 1, pp. 95–107, 1987, Michael B. Spektor.

Minimization of Energy Consumption of Soil Deformation, Journal of Terramechanics, 1980, vol. 17, No. 2, pp. 63–77, M. Spektor.

Principles of Soil-Tool Interaction, *Journal of Terramechanics,* 1981, vol. 18, No. 1, pp. 51–65, M. Spektor.

Motion of Soil-Working Tool Under Impact Loading, *Journal of Terramechanics,* 1981, vol. 18, No. 3, pp. 133–156, M. Spektor.

Working Process of Cyclic-Action Machinery for Soil Deformation-Part 1, *Jorunal of Terramechanics,* 1983, vol. 20, No. 1, pp. 13–41, Spektor.

*Primary Examiner*—Bruce M. Kisliuk

*Attorney, Agent, or Firm*—Foley & Lardner

[57] ABSTRACT

A self-propelled, pneumopercussive, cyclic action, ground penetrating machine (200) has decreased energy consumption and increased average working velocity compared to conventional machines. This is obtained in part by a valve-operated air-distribution mechanism (203) having separated forward and reverse compressed air supply lines (35, 37), which mechanism (203) does not limit the length of the forward and backward strokes of the striker (202). This mechanism allows the backward stroke chamber (75) to be connected with the atmosphere during the entire forward stroke of the striker (202). This eliminates generation of an air buffer in the backward stroke chamber (75) and, consequently, the striker (202) does not lose part of its kinetic energy before impact. The invention also provides a cyclic action braking mechanism (204), a forward/reverse mode control system (205) which can be pneumatically actuated, a movable chisel (207) which utilizes the energy of the striker more efficiently and has a gasket (72) to prevent jamming, and a sensor (208) for monitoring the impact frequency of the machine (200) so that it can be quickly switched to reverse mode upon encountering an obstacle.

44 Claims, 10 Drawing Sheets

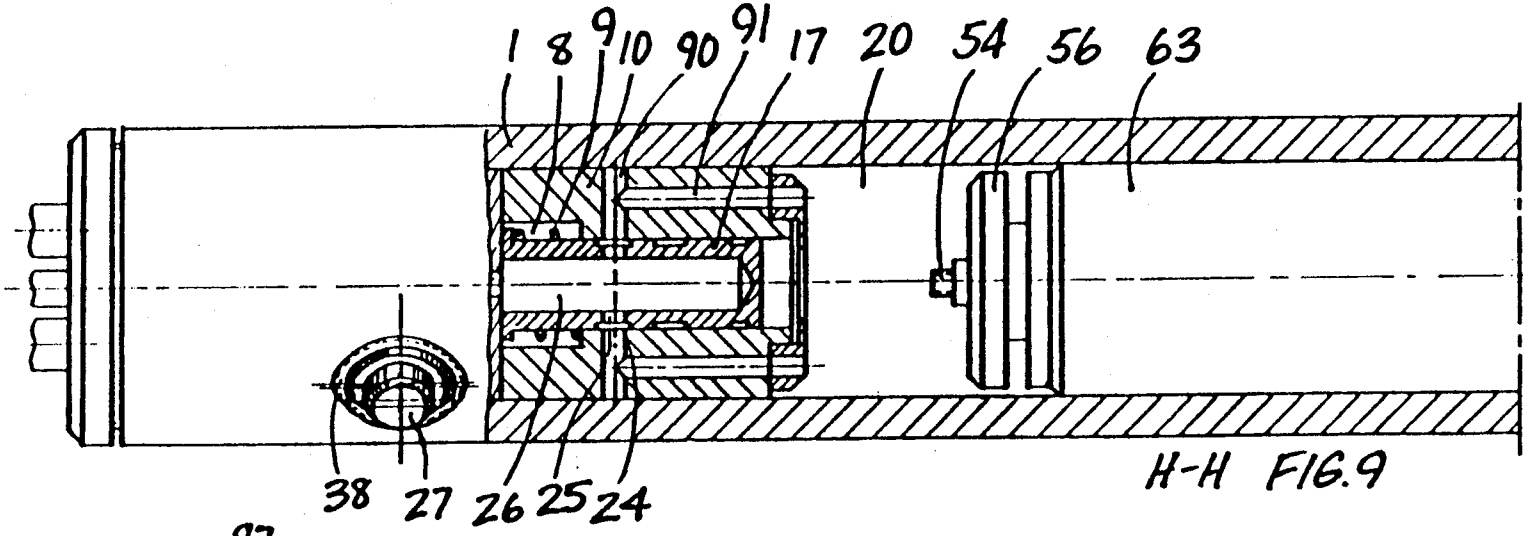
H-H FIG.9
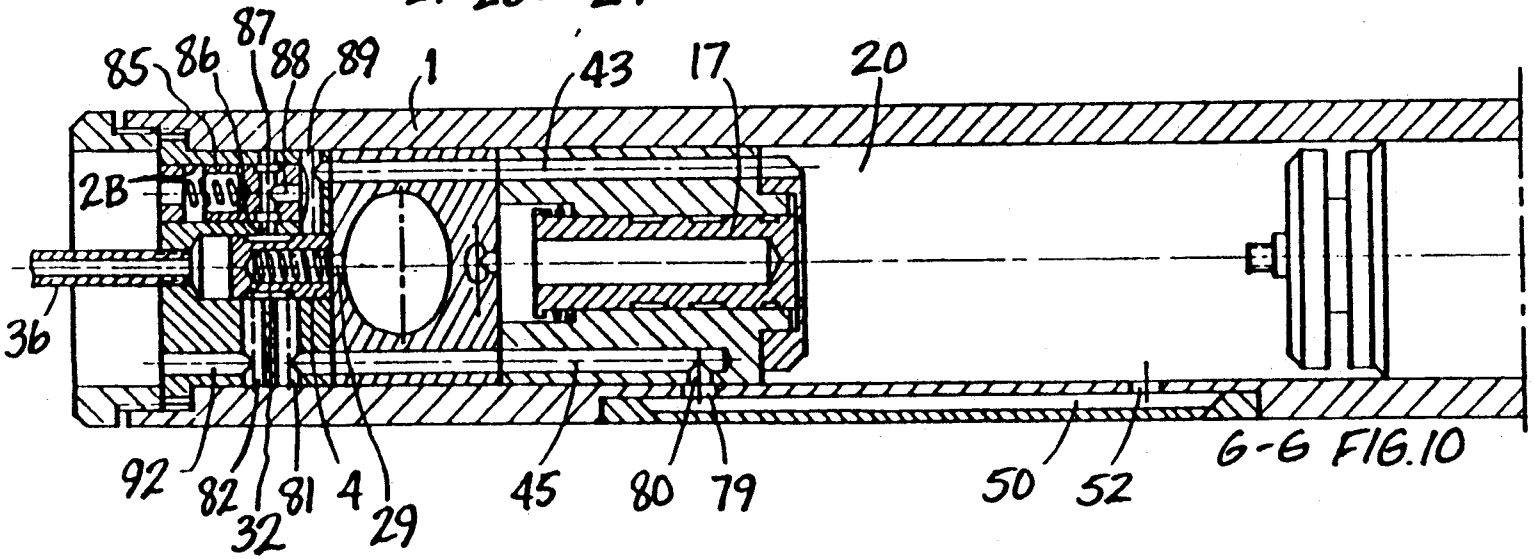
6-6 FIG.10

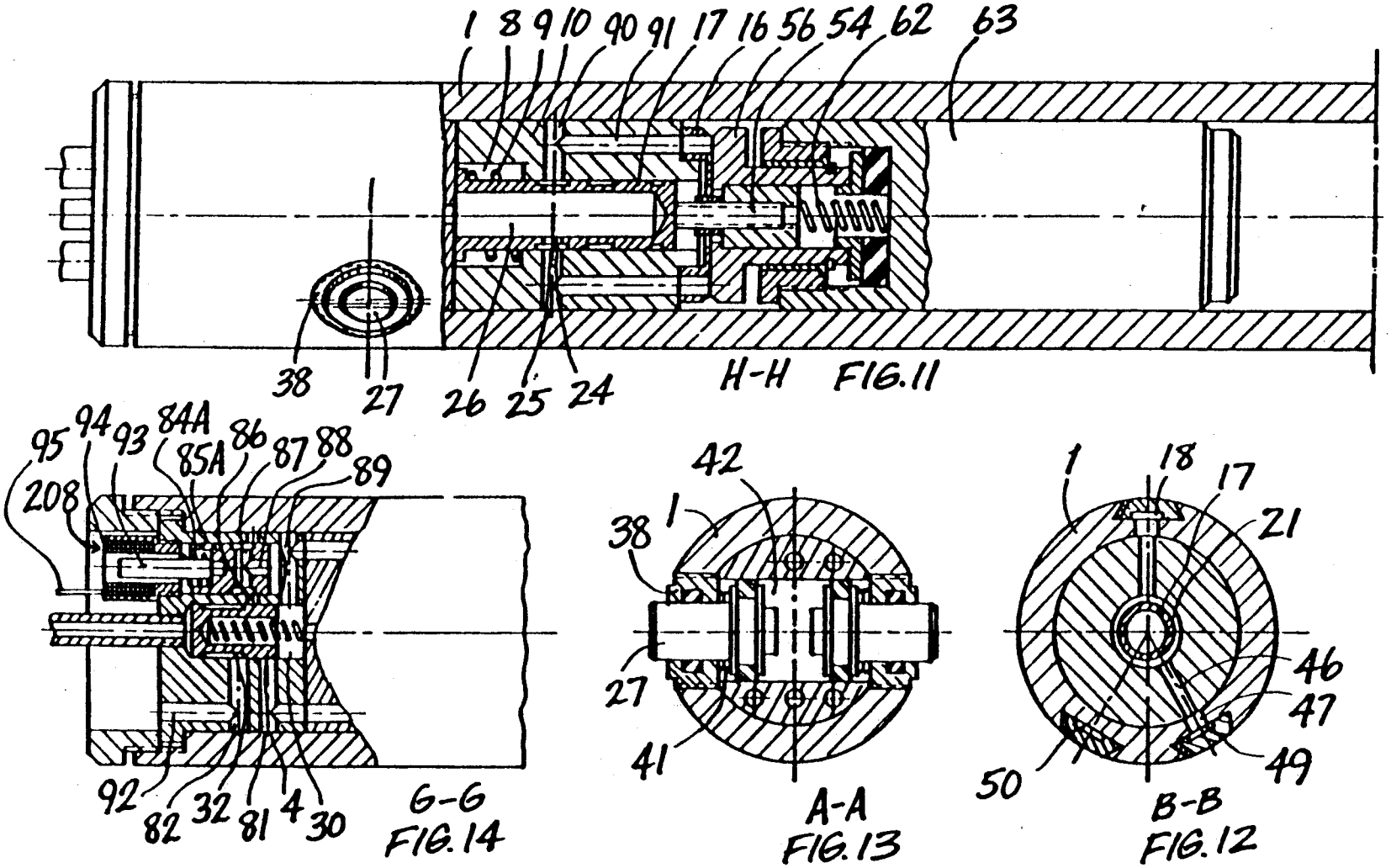
63
62
54
56
16
17
91
90
10
9
8
1
24
25
26
27
38
H-H FIG. 11
21
17
18
1
46
47
49
50
B-B FIG. 12
42
1
38
27
41
A-A FIG. 13
89
88
87
86
85A
84A
93
94
95
208
4
30
81
32
82
92
G-G FIG. 14

K-K

G-G

M-M

N-N

P

PNEUMOPERCUSSIVE SOIL PENETRATING MACHINE

FIELD OF THE INVENTION

The present invention relates generally to pneumatic, self-propelled, percussive cyclic action underground penetrating machinery of the type used for making holes in the ground, driving pipes into the ground, or driving explosives into the ground for mining or military engineering.

BACKGROUND OF THE INVENTION

Air-operated self-propelled percussive cyclic action machines for making holes in the soil are known. These machines comprise a hollow cylindrical housing, having a pointed head section, a striker which reciprocates inside the housing, and an air-distributing mechanism. The principle of operation of these machines is as follows. During one cycle of machine operation the striker executes a forward and then a backward stroke. At the end of the forward stroke the striker, being accelerated by compressed air, imparts an impact to the front end of the housing. As a result, the machine penetrates the soil by a certain increment of displacement. During the backward stroke the striker is braked, e.g., by an air buffer which develops in the space between the rear end of the striker and the housing. The air buffer prevents a collision between the striker and the housing, so that the striker stops and a new cycle begins. Machines of this type are in Zinkiewicz, U.S. Pat. No. 3,137,483 and Zygmunt, U.S. Pat. No. 3,407,884

A number of inherent disadvantages have prevented the extensive utilization of these machines. One of the main shortcomings of these machines is the insufficient reliability of the air-distributing mechanism. Improved versions of these machines, based on a valveless air-distributing system, were later developed. The valveless air-distribution system described in U.K. Patent No. 800,725, published Sept. 3, 1958 was later used in a soil penetrating machine described in U.S. Pat. No. 3,410,354, issued to Sudnishnikov et al. in November, 1968. U.S. Pat. No. 3,651,874, issued to Sudnishnikov et al. in March, 1972, described a reversible valveless machine for making holes in the soil. This machine provided a threaded connection between the air supply sleeve and the machine body, allowing the stroke of the striker to be displaced rearwardly.

Subsequent patents illustrate that the valveless machines of Sudnishnikov et al. suffered from various problems. U.S. Pat. No. 3,708,023 issued to Nazarov et al. in January, 1973, noted that prior selfpropelled machines did not possess sufficient impact power, and proposed to solve the problem by providing an auxiliary pressure chamber at the head of the machine. U.S. Pat. No. 3,727,701, issued to Sudnishnikov et al. in April, 1973, mentions that, in known reversible air-punching machines for making holes in the soil, pressure fluctuations may result in an uncontrollable shifting of the machine from the forward to reverse mode, and vise versa.

In U.S. Pat. No. 3,744,576, issued to Sudnishnikov et al. in July, 1973, it is stated that the screw reversing mechanisms of known pneumopercussive machines, which require rotating the air supply hose to displace the stroke of the striker, are difficult and sometimes impossible to use. Nonetheless, Sudnishnikov et al., U.S. Pat. No. 3,756,328, issued September 1973, still shows a screw reversing mechanism which must be manually actuated by rotating the air hose. The '328 patent further describes a resilient shock-damping means having longitudinal air exhaust passages designed to prevent from early breakdown of the air-distributing mechanism. Machines based on U.S. Pat. No. 3,756,328 are still in use.

Subsequent patents describe a variety of largely unsuccessful attempts to improve the reversing mechanism of valveless soil penetrating machines. Sudnishnikov et al., U.S. Pat. No. 4,078,619, issued in March, 1978, discloses an improvement to the reversing mechanism. According to this patent, the reversing mechanism is actuated by manually pulling on the air supply hose. Tkach et al., U.S. Pat. No. 4,121,672, issued in October, 1978, offers an improvement to the means for rotating the air supply hose. U.S. Pat. No. 4,132,277, issued to Tupitsyn et al. in January, 1979, also describes a reversing mechanism which is activated by pulling the air supply hose. U.S. Pat. No. 4,214,638 issued July 1980 to Sudnishnikov et al., states that controlling the reverse mechanism by rotating or pulling the air supply hose is time consuming, difficult and, in certain cases, altogether impossible. This has proven true in practice particularly when it is necessary to reverse the machine when the machine is far underground.

To address these problems, Schmidt, U.S. Pat. No. 4,295,533, issued October, 1981, suggests rotating a component in the reversing mechanism by a flexible shaft enclosed within the air supply hose. Bouplon, U.S. Pat. No. 4,662,457, issued May, 1987, offers an improved reversing mechanism which requires rotating the air-supplying hose approximately a quarter of a turn. U.S. Pat. No. 4,683,960, issued August, 1987, to Kostylev et al., describes a reversing mechanism based on pulling a separate cable instead of the airsupplying hose. None of these manually-operable reversing mechanisms have completely eliminated the problems with the screw reverse mechanism.

A different approach to control the reversing mechanism is proposed in Schmidt, U.S. Pat. No. 4,250,972, issued February, 1981. According to this patent, the reversing mechanism is controlled by a secondary air supply line to the device, or electrically. However, this system has not found widespread use.

This brief analysis of the valveless pneumo-percussive underground penetrating machines shows that, during the last two decades, many unsuccessful efforts were made to improve the control system of the reversing mechanism for underground penetrating machines. However, despite these efforts, the basic screw reverse operated by rotating the air supply hose a dozen times or more remains in widespread use.

Other improvements to the valveless soil penetrating machine of U.S. Pat. No. 3,410,354 have also been proposed. Schmidt, U.S. Pat. No. 3,865,200, issued February, 1975, describes a movable chisel and an intermediate piston having interposed elastic members. This patent asserts that this reduces impact loading on the housing of the penetrating machine, and also reduces the required "percussion energy" in comparison with conventional driving machines. Although this design does reduce impact loading on the housing, there is an energy loss due to the intermediate piston. In addition, the movable chisel is ineffective because, after a number of working cycles, particles of soil penetrate fill the gap between the chisel and the housing, so that the chisel becomes jammed in the forwardmost position. The intermediate piston and movable chisel disappeared from the later machines by the same inventor (See Schmidt, U.S. Pat. Nos. 4,250,972 and 4,295,533). A movable chisel is also shown in the U.S. Pat. No. 4,100,980 issued to Jenne in July, 1978. This design is also unworkable for the same reasons as in the Schmidt device.

Energy consumption and productivity are among the most important parameters of a working process of a machine. During the last decade several scientific papers, related to the energy consumption and productivity (or average velocity) of underground percussive penetrating machines have been published by the present inventor. See Minimization of Energy Consumption of Soil Deformation, *Journal of Terramechanics,* 1980, Volume 17, Number 2, pages 63 to 77; Principles of Soil-Tool Interaction, *Journal of Terramechanics,* 1981, Volume 18, Number 1, Pages 51 to 65; Motion of Soil-Working Tool Under Impact Loading, *Journal of Terramechanics,* 1981, Volume 18, Number 3, Pages 133 to 156; Working Process of Cyclic-Action Machinery for Soil Deformation-Part 1, Journal of Terramechanics, 1983, Volume 20, Number 1, Pages 13 to 41; Minimum Energy Consumption of Soil Working Cyclic Processes, *Journal of Terramechanics,* 1987, Volume 24, Number 1, Pages 95 to 107). According to the data presented in these papers, the process of vibratory soil penetration can be optimized to obtain minimum energy consumption. By comparing the performance of the conventional pneumopercussive hole making machines with the performance possible using minimum energy consumption, it becomes clear that conventional machines are characterized by relatively high energy consumption and relatively low productivity. Development of new machines based on optimization with respect to minimum energy consumption will decrease the flow rate of the compressed air and also simultaneously increase the average velocity of these machines.

To optimize the boring process, it is essential to increase the kinetic energy that the housing obtains from an impact of the striker. One way to increase this kinetic energy consists of lengthening the forward stroke of the striker. However, the structure of the valveless air-distributing mechanism of known pneumopercussive underground penetrating machines makes it very difficult or almost impossible to increase the striker stroke length to a considerable extent. The reason is that the backward stroke of the striker occurs under the action of a portion of the compressed air which enters the rear stroke chamber through holes that remain open a short time. These holes are then closed by overlap of the striker during the beginning of its backward stroke. Pressure force of the expanding air moves the striker backward. In the forward stroke chamber there is constant air pressure. The striker moves backward because the active, cross-sectional area of the striker for the backward stroke exceeds the active cross-sectional area for the forward stroke. However, the backward stroke cannot be relatively long because the pressure of the expanding air in the backward stroke chamber air drops rapidly as the pressure in the forward stroke chamber brakes the striker. Thus, the valveless air-distributing mechanisms of the type discussed above inherently require relatively short striker stroke lengths. The valveless air-distributing mechanism of conventional machines is not appropriate for relatively long stroke machines, for example, 1.5 to 2 times.

Another inherent disadvantage of conventional pneumopercussive underground boring machines is that the backward stroke chamber is connected with the atmosphere for just a brief period during the forward stroke of the striker. This creates an air buffer in the backward stroke chamber and brakes the striker before it imparts an impact, thereby decreasing the kinetic energy of the striker before impact. The auxiliary chamber proposed in the foregoing patent to Nazarov et al. has not proven an effective solution to this problem.

A further disadvantage of known pneumo-percussive underground machines concerns the ratio between the external frictional force of the soil distributed over the surface of the housing and the rearward air pressure force applied to the inside rear end of the housing during the forward stroke of the striker, i.e., the recoil of the housing as the striker moves forward. Under working conditions this ratio is in the range from 0.3 to 0.75, while the optimum value of this ratio, as taught in the literature, is 1.0. This means that, under actual working conditions, the housing moves backward during the forward stroke of the striker. Such movement negates a certain part of the stroke length, and the housing gains a negative velocity before the collision. The striker cannot actually utilize the entire stroke length and, consequently, has less kinetic energy before collision. The decreased kinetic energy of the striker and the backward velocity of the housing before collision in turn reduce the kinetic energy of the housing after the collision, reducing the overall efficiency of the machine.

Still another inherent disadvantage of known pneumopercussive underground penetrating machines is associated with the transmission of kinetic energy from the striker to the housing. The best situation is when the rebound energy of the striker is equal to zero so that the housing gains the maximum possible energy from the striker. Collision theory dictates that, in order to obtain ideal transfer of energy from the colliding mass to a motionless collided mass, the ratio between the colliding mass and the collided mass must equal the value of the restitution coefficient of the two masses. However, in conventional pneumopercussive underground penetrating machines, the ratio of these masses is significantly less that the restitution coefficient. This causes the striker to rebound so that part of the kinetic energy of the striker is *not* transferred housing. Ideally, the striker should stop dead in the same way a billiard ball does when striking another ball.

Still another inherent disadvantage of conventional pneumopercussive underground hole making machines is the lack of a means for independently controlling the compressed air in the forward and backward stroke chambers. Under some working conditions the striker can impart undesirable impacts to the rear end of the housing. These impacts can be avoided by controlling the air pressure in the backward stroke chamber. Similarly, when the machine is in reverse mode it may be necessary to control the pressure of the compressed air in the forward stroke chamber to prevent forward impacts. Independent control of the compressed air in the forward and backward stroke chambers can also improve the efficiency and restarting ability of the machine.

One more inherent disadvantage of conventional pneumopercussive underground penetrating machines is the lack of a means for monitoring the working process of the machine. The striker frequency and pressure in the forward stroke chamber change depending on operating conditions. The impact frequency and air pressure for the forward penetrating mode and the reverse mode of the machine are different. The impact frequency also changes, e.g., when the machine meets an obstacle, or when the machine works in loosened soil. If the operator could be aware of these changes during operation, he or she could make appropriate decisions, for instance, when to reverse the machine when it meets an obstacle. In practice, these changes cannot be recognized by simply listening to the machine, and thus conventional boring machines lack any effective monitoring system.

Still another disadvantage of conventional pneumopercussive boring machines is the high impact loading that the housing experiences during operation. Severe fatigue appears in the housing that considerably decreases its service life.

The present invention addresses these disadvantages, making it possible to increase the efficiency of the machine to a considerable extent.

SUMMARY OF THE INVENTION

This invention provides a self-propelled, pneumopercussive, cyclic-action, ground penetrating machine having decreased energy consumption and increased average working velocity compared to conventional machines. This is obtained in part by a valve-operated air-distribution mechanism that does not limit the length of the forward and backward strokes of the striker. This mechanism allows the backward stroke chamber (the chamber in front of the striker) to be connected with the atmosphere during the entire forward stroke of the striker. This eliminates generation of an air buffer in the backward stroke chamber and, consequently, the striker does not lose part of its kinetic energy before impact.

According to a further aspect of the invention, a valve-operated air-distributing mechanism also includes a cyclic-action braking mechanism which keeps the housing from moving backwards during the forward stroke of the striker. This permits the striker to utilize the entire length of the forward stroke and, consequently, to gain as much kinetic energy before impact as possible. This provides the machine housing with the highest possible kinetic energy after the collision.

According to another aspect of the invention, improved transmission of energy from the striker to the housing during the collision and decreased periodic impact loading on the housing are attained by providing a movable chisel separate from the rest of the housing. An elastic seal is provided in the space between the chisel and the body of the housing to prevent soil from entering the space behind the chisel and jamming it.

The chisel can have any desired mass. If the ratio between the mass of the striker and the motionless body it collides with (the chisel) equals the restitution coefficient for the collision, then the kinetic energy of the striker will be completely transmitted to the chisel. The resistance forces of motion of the chisel also include the inertia of the hollow part of the housing and associated parts secured thereto which are separate from the chisel. However, the gain in kinetic energy of the chisel resulting from the complete transmission of the kinetic energy from the striker to the chisel exceeds the loss due to inertia of the machine body, so that the machine is propelled forwardly. In a preferred embodiment, loading from the chisel to the hollow part of the housing is transmitted through an elastic element which transforms the instantaneous force applied to the chisel into a gradually changing force applied to the housing, protecting the housing from excessive impact loads.

Another embodiment of the invention provides separate control of compressed air in the forward and backward stroke chambers. This is attained by providing the valve-operated air-distributing mechanism with two separate air supply lines connected by flexible hoses with the source of compressed air. Separate control of the compressed air in the forward and backward chambers improves the performance of the machine in the forward and reverse modes of operation. Control of compressed air in the backward stroke chamber can avoid undesirable impacts of the striker on the rear end of the housing during forward movement of the machine. Coordinated control of compressed air in the forward and backward chambers as described below can also improve the performance of the machine in the reverse mode of operation. In addition, compressed air flow in the forward and backward stroke chambers can be manipulated to allow starting or restarting of the machine in any striker position.

A further embodiment of the invention provides the machine with a reliable reversible mechanism having a simple control system which avoids any need to rotate an air supply hose. This is achieved, for example, by providing the air-distributing mechanism with a mode control valve which is permanently connected by a small air hose to a valve mounted on the source of compressed air. The mode of the machine operation is changed by opening and closing the reversing valve. In the illustrated embodiment, when this valve is closed the machine works in the forward mode to penetrate the soil. When this valve is open the compressed air changes the position of the reversing valve, causing reverse operation of the machine. The mode control valve can also be electrically actuated.

An additional feature of the invention is a sensor mounted on the machine which provides the machine operator with relevant current information about the working process of the machine. Such information facilitates decision-making, for instance, in determining when to switch to reverse mode. This can be achieved by providing a transducer connected to the forward stroke chamber. This transducer generates an electrical signal which reflects fluctuations of the compressed air in the forward stroke chamber, and can be electrically connected to a portable electronic device that analyzes the signal and provides a visible read-out on a screen or the like. Simulating different modes of the working process of the machine can be used to calibrate the transducer and aid in interpretation of the signals. These and other aspects of the invention will become apparent from the detailed description of the illustrated embodiments.

BRIEF DESCRIPTION OF THE DRAWING

The invention will be further described with reference to the accompanying drawing, wherein like numerals denote like elements, and:

FIGS. 1*a* and 1*b*, of which FIG. 1*b* is a continuation of FIG. 1*a*, are longitudinal sectional views of a self-propelled, pneumopercussive, reversible, soil-penetrating machine according to the invention. The components of the machine are positioned for forward mode operation at the beginning of the backward stroke of the striker.

FIG. 2 is a cross-sectional view taken along the line A—A in FIG. 1*a*.

FIG. 3 is a cross-sectional view taken along the line B—B in FIG. 1*a*.

FIG. 4 is a cross-sectional view taken along the line C—C in FIG. 1*a*.

FIG. 9 is a partial longitudinal sectional view taken along the line H-H in FIG. 4, with the machine components positioned for the forward stroke of the striker with bra pins extended.

FIG. 10 the same view as FIG. 8, but the machine components are positioned for reverse mode operation during the middle of the forward stroke of the striker. For purposes of clarity, the braking mechanism is not shown FIGS. 8 and 10.

FIG. 11 is same view as FIG. 9, with the striker partly in section, showing the machine components in reverse mode as the striker makes a rearward impact.

FIG. 12 is the same view as FIG. 3, but with the stroke control valve shown in its rear (left) end position. The components are in position for the forward stroke of the striker for both forward and reverse modes.

FIG. 13 is the same view as FIG. 2, but showing the braking pins extended. The components are in position for the forward stroke of the striker with the machine in forward mode.

FIG. 14 is the same view as FIG. 8, partly in section, but illustrates an alternative embodiment of a machine of the invention provided with a sensor.

DESCRIPTION OF THE ILLUSTRATED EMBODIMENTS

A. General Description

Figure 1A:
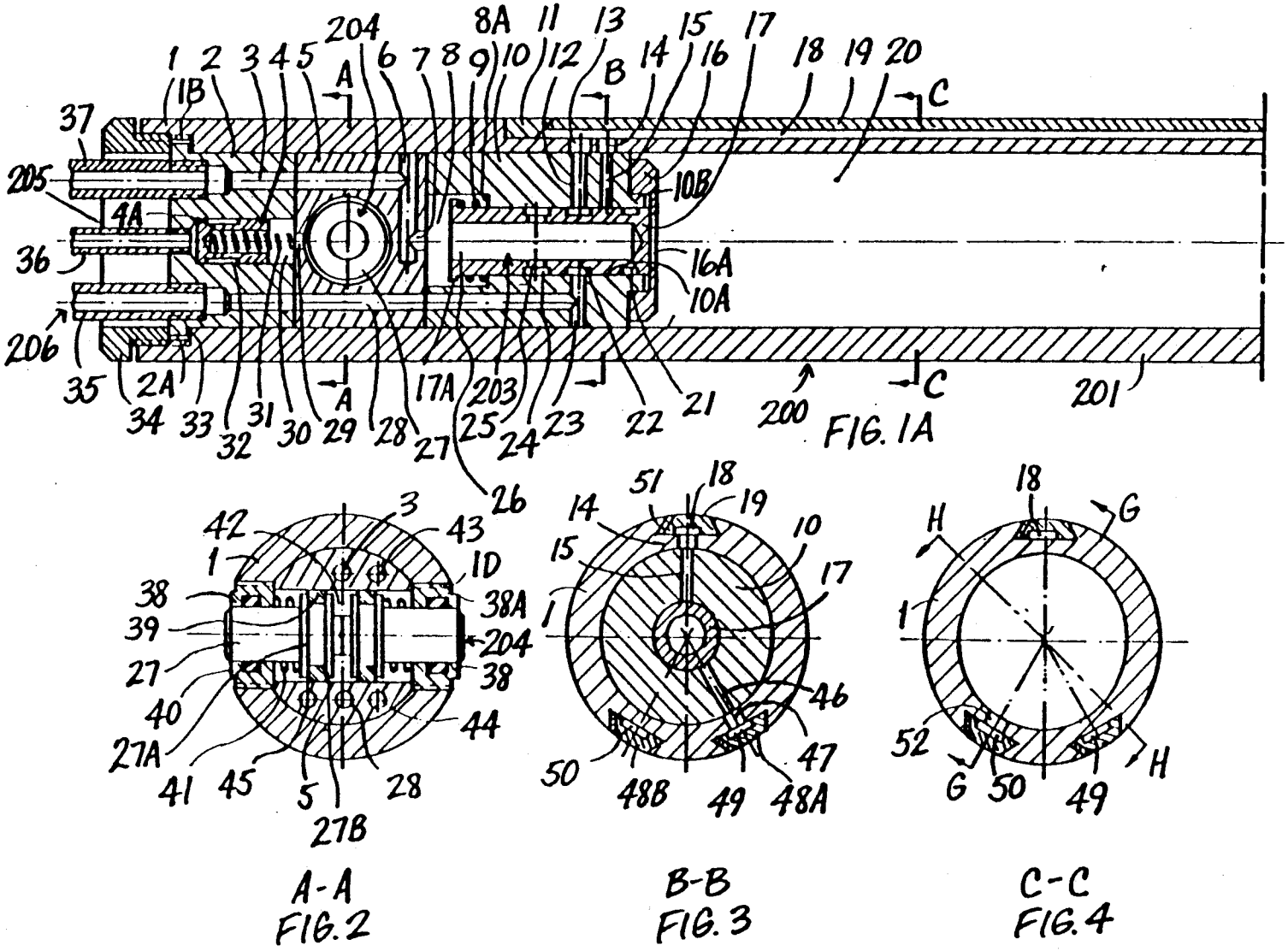
Figure 1B:
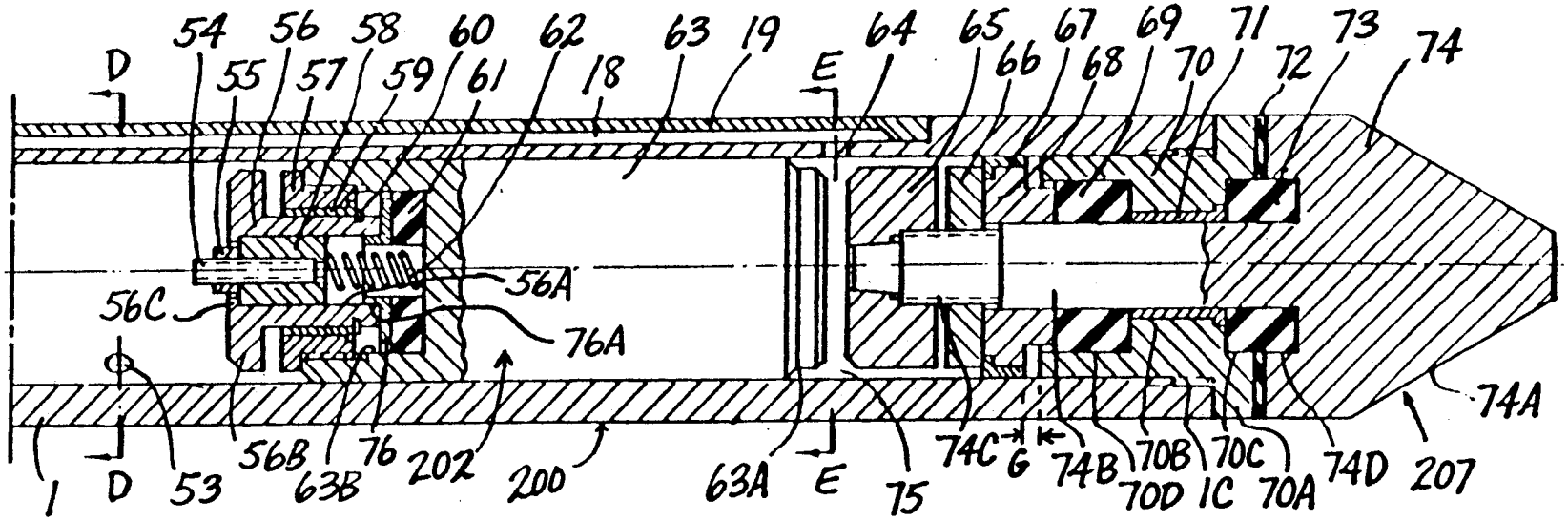
Figure 6:
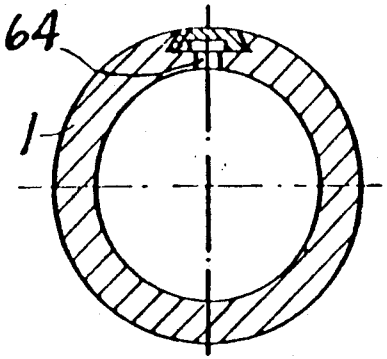
FIG. 6 is a cross-sectional view taken along the line E—E in FIG. 1*b*.
Figure 5:
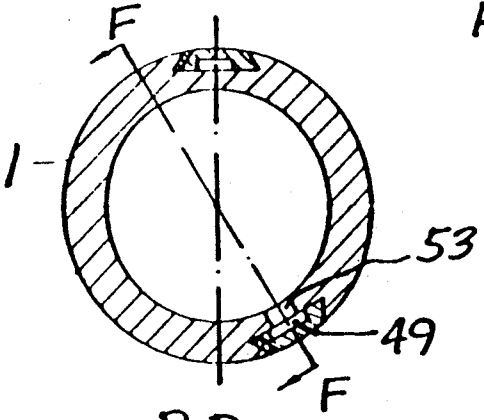
FIG. 5 is a cross-sectional view taken along the line D—D in FIG. 1*b*.

Referring to FIGS. 1*a* and 1*b*, a pneumo-percusive reversible soil penetrating machine 200 according to the invention includes, as major components, an elongated body 201 having an open rear end; a striker 202 disposed for reciprocation within body 201; a valve-operated air-distributing mechanism 203 secured in body 201 rearwardly of striker 202 for supplying compressed air to reciprocate striker 202; a cyclic action braking mechanism 204 actuated by air distributing mechanism 203 and located towards the rear of body 201, which brakes machine 200 against recoil when a forward stroke chamber 20 is pressurized; a forward-/reverse mode control system 205 which is connected to the air distributing mechanism 203 for altering the flow of compressed air therein to cause striker 202 to drive machine 200 rearwardly instead of forwardly, or the reverse; an air supply system 206 which supplies air to distributing mechanism 203, a movable chisel assembly 207 which receives forward impacts from striker 202. Each of these components will hereafter be described in detail. For purposes of brevity, details of the air flow passages formed in machine 200 as part of air distributing mechanism 203 will be described only in the sections below on machine operation.

As shown in FIGS. 1*a*, 1*b*, and 2-4, a generally torpedo-shaped body 201 includes an elongated tubular housing 1 and a tubular tail nut 34 which is threadedly secured in the open rear end of housing 1 for retaining a stack of cylindrical, front middle and rear cylinders 10, 5, 2 which are rigidly secured together by a bolt (not shown) to form systems 203-205. Nut 34 engages a rear flange 2A of rear cylinder 2 and holds it against the inner annular wall of a threaded, rearwardly opening counterbore 1B in housing 1. Nut 34 may optionally include a dirt protector (not shown) for preventing soil and other foreign objects from penetrating into the central hole of nut 34, such as an elastomeric flapper valve and/or a rearwardly tapering frustoconical tail-piece similar to those used on conventional ground piercing machines.

Figure 15:
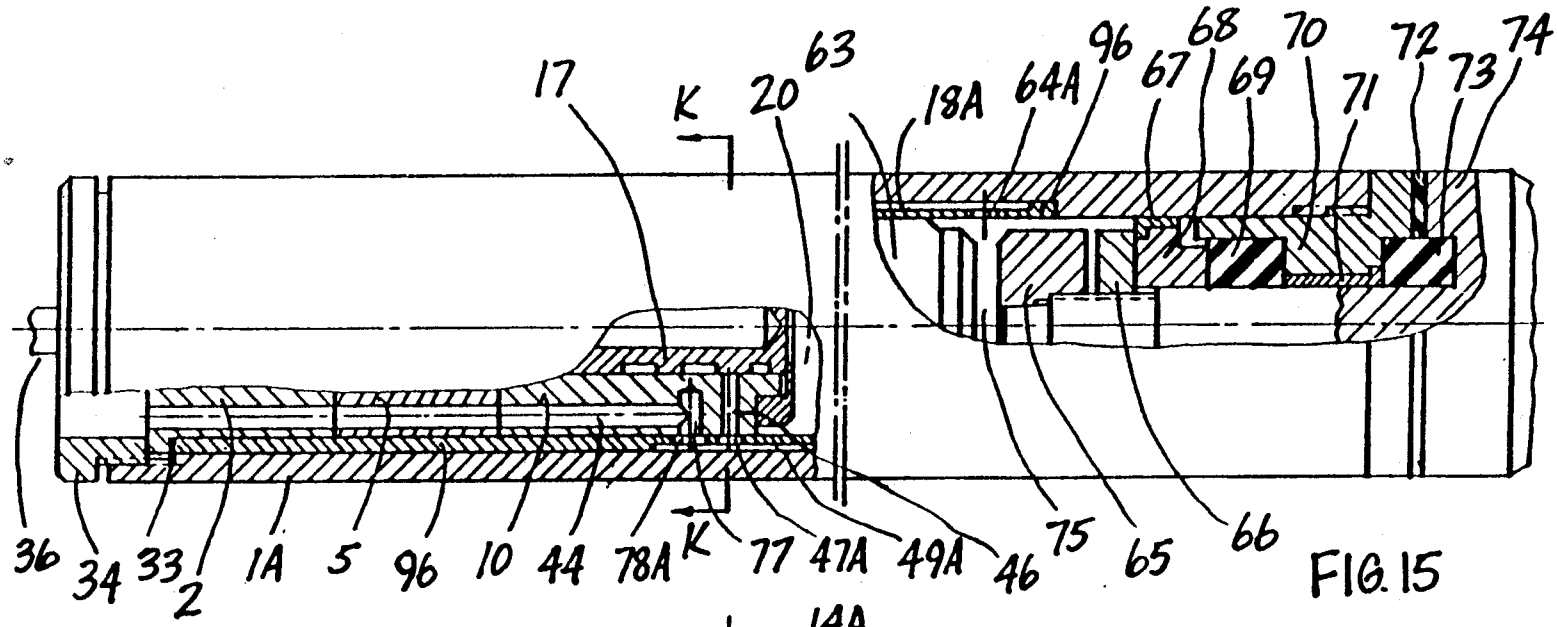
FIG. 15 is a partial, longitudinal sectional view of alternative embodiment of the invention. The are positioned as in FIGS. 1*a*, 1*b*.
Figure 16:
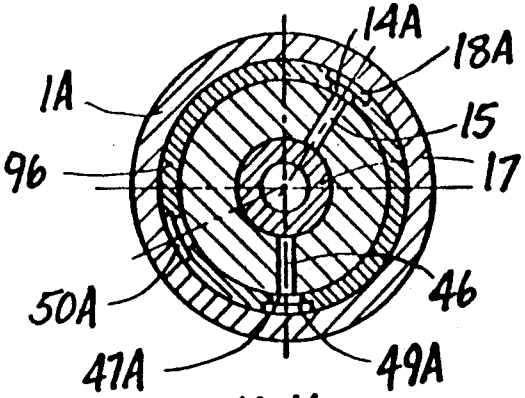
FIG. 16 is a cross-sectional view taken along the line K—K in FIG. 15.

Referring to FIG. 3, housing 1 has lengthwise air flow passages 18, 49 and 50 therein which are machined into the outer surface of housing 1 as grooves having inwardly tapering side walls which render the grooves trapezoidal in cross section. Trapezoidal, elongated inserts (covers) 19, 48*b*, 48*a* are inserted into the associated grooves in housing 1 and secured by end clips 11 and lengthwise filling wedges 51. Grooves in the undersides of inserts 19, 48*b*, 48*a* define passages 18, 50, 49, respectively. FIGS. 15 and 16 illustrate an alternative housing 1*a* which lacks exterior grooves for forming the air flow passages. In lieu thereof, an inner sleeve 96 made of a low-friction material such as cast iron, bronze, or composite materials is disposed coaxially with housing 1*a*, and passages 18*a*, 49*a*, and 50*a* are machined into the outer surface of sleeve 96. The low-friction material is important for decreasing frictional wear between the inner sleeve and the striker.

Referring now to FIGS. 1*b* and 15, movable chisel assembly 207 is mounted in a threaded front counterbore 1*c* in housing 1 and makes up the frontwardly tapering nose of machine 200. Assembly 207 includes the chisel 74 having a frontwardly tapering head 74*a* (the nose of the machine), and an elongated, rearwardly extending shank 74*b* having a threaded rear end 74*c*. A nut 65 of greater diameter than shank 74*b* is threadedly secured to threaded end 74*c*. Nut 65 acts as the front anvil which receives forward impacts from striker 202.

To be effective for improving the efficiency of the energy transfer from striker 202, suitable means must be provided for supporting chisel 74 for sliding axial movement over a short distance. In the illustrated embodiment, a tubular adapter 70 having a front annular flange 70*a* of the same diameter as housing 1 is threadedly secured in threaded counterbore 1*c* of housing 1. Adapter 70 has a bore 70*b* which includes a pair of enlarged diameter, frontwardly and rearwardly opening counterbores 70*c*, 70*d*. Shank 74*b* is slidably disposed in a bushing 71 which is fitted into bore 70*b* between counterbores 70*c,d*. A pair of front and rear, elastic shock absorbers 73, 69, such as coil springs, Belleville springs, or elastomeric rings (shown), are mounted in counterbores 70*c*, 70*d*, respectively. Front shock absorber 73 is partly confined in a rearwardly opening recess 74*d* in head 74*a* of chisel 74.

An annular elastic gasket (sealing ring) 72 is interposed between chisel head 74*a* and flange 70*a* of adapter 70. Gasket 72 is confined under a certain compression between the associated surfaces of head 74*a* and flange 70*a* for filling the space therebetween during forward movement of chisel 74. Rear shock absorber (spring) 69 biases chisel 74 towards the left, retracted shown in FIG. 1*b* and, in so doing, compresses gasket 72. Gasket 72 thereby prevents particles of soil from entering behind head 74*a* which would jam chisel 74 in its forwardmost position, causing machine 200 to lose the benefit of efficient kinetic energy transfer between striker 202 and chisel 74.

A thrust journal 68 is coaxially secured to the outer periphery of shank 74*b* rearwardly adjacent to shock absorber 69. Journal 68 has a stepped, rear annular flange 68*a* fitted with an external bushing 67 which is in sliding contact with the inner surface of housing 1. A spacer ring 66 is threadedly secured to threaded end 74*c* to retain journal 68 in a position which will suitably compress shock absorbers 69, 73 and gasket 72. Gap G, the clearance between journal 68 and adapter 70, exceeds the distance chisel 74 moves during a forward impact of striker 202.

Referring again to FIG. 1*b*, striker 202 comprises a solid cylinder 63 having a stepped front end 63*a* of reduced diameter for facilitating air flow about striker 202 and a rearwardly opening threaded recess 63*b* in which a shock-absorbing rear impact assembly is provided. The outer peripheral surface of cylinder 63 is in sealing, slidable contact with the interior of housing 1. Unlike prior machines which require the striker to be mounted on a stepped inner valve sleeve, the striker according to the present invention defines only a single sliding pair, thereby avoiding problems with air leakage around short bearing surfaces and jamming which occurs due to misalignment of the stepped sleeve and the striker.

The rear impact assembly includes a shock absorbing ring 61 disposed in close conformity with the bottom of recess 63*b*. A flat thrust journal 76 is disposed against the outer face of shock absorber 61, a rearwardly extending annular flange 76*a* thereof is in turn received in a central hole 56*a* of a sleeve (rear impact hammer) 56. Sleeve 56 further has a rear radial flange 56*b* which functions as the rear impact surface of striker 202 when the machine is in reverse mode, as described hereafter. A retaining ring 60 is mounted in an annular outer groove near the front end of sleeve 56 so that ring 60 projects radially therefrom. A nut 57 fitted with an inner bushing 59 is threadedly secured in recess 63*b* so that an outwardly directed annular flange of bushing 59 engages ring 60 and thereby secures sleeve 56, journal 76 and shock absorber 61 in a rearwardmost position in recess 63*b*. The cylindrical outer surface of sleeve 56 is slidably disposed in bushing 59 so that, when rear flange 56*b* engages a rear anvil 16, the resulting shock is dampened by compression of shock absorber 61. This results in less violent striker impacts when the machine is in reverse mode, lengthening machine life.

A valve tappet 54 is centrally mounted in hole 56*a* for engaging a spring loaded stroke control valve 17 to initiate the forward stroke of striker 202. Tappet 54 comprises a threaded rod received in a central threaded hole of a cylindrical holder 58 and clamped thereto by nut 55. A helical compression spring 62 confined between a front wall of holder 58 and the bottom of recess 63*b* inwardly of shock absorber 61 and thrust journal 76 resiliently biases holder 58 against an inwardly directed retaining rim 56*c* at the front end of hole 56*a*. By this means tappet 54, holder 58 and nut 55 can slide forwardly along hole 56*a* when tappet 54 engages valve 17, compressing spring 62. Tappet 54 extends rearwardly beyond flange 56*b*, so that contact between tappet 54 and valve 17 occurs prior to contact between flange 56*b* and rear anvil 16. Spring 62 is designed so that tappet 54 does not damage valve 17 during contact therewith, the main force of the rearward impact being exerted against anvil 16. When striker 202 moves away from rear anvil 16 during its forward stroke, spring 62 forces holder 58 rearwardly back into contact with stop (rim) 56*c*.

Referring now to FIGS. 1*a* and 3, the air distributing mechanism 203 according to the invention includes a spring-loaded stroke control valve 17 which is slidably disposed in a central bore 10*a* of front cylinder 10. Valve 17 has a rearwardly opening recess (blind hole) 26 therein which is in communication with a chamber 8 formed by a rear counterbore in cylinder 10, i.e., an enlarged diameter rear portion of bore 10*a*. Cylinder 10 further has an annular, frontwardly extending boss 10*b* on which the rear anvil 16 is secured by screws (not shown) to cylinder 10. Anvil 16 resembles an annular cover and has a central hole 16*a* therein which permits tappet 54 to contact the front end wall of valve 17. A rear end portion of valve 17 extends into chamber 8 and ends in a rear, outwardly-directed annular flange 17*a*. A compression spring 9 is confined between flange 17*a* and an annular inner wall 8*a* of chamber 8 for biasing valve 17 to a left end position as shown in FIG. 9. Three parallel, spaced, annular grooves 24, 22 and 21 are formed in the outer periphery of valve 17.

Groove 24 communicates with recess 26 through radial holes 25. Grooves 21, 22 do not communicate with recess 26. Grooves 24, 22, 21 work in cooperation with passages 12, 15, 23 and 46 formed in cylinder 10 and associated passages in housing 1 for conducting compressed air to a forward stroke chamber 20 and a rearward stroke chamber 75. Forward stroke chamber 20 comprises the space within housing 1 forwardly of cylinder 10 and rearwardly of striker 202, whereas rear stroke chamber 75 comprises the space within housing 1 forwardly of striker 202 and rearwardly of chisel 207. The volume of each of chambers 20, 75 varies depending on the position of striker 202.

Referring to FIG. 1*a*, the compressed air supply system 206 according to the invention includes air supply pipes 37, 36 and 35 connected by respective flexible hoses to an air compressor provided with valves for separately controlling the air pressure in each of pipes 35-37. Pipe 37, which supplies compressed air for the forward stroke of the striker, is threadedly secured in a rearwardly opening passage 3 in rear cylinder 2. Passage 3 in turn communicates with passages 6, 7 in middle cylinder 5 which leads to chamber 8. Compressed air from pipe 35 thus flows directly into chamber 8.

Pipe 35 supplies compressed air for the rearward stroke of striker 202 through a passage 28 in cylinders 2, 5, 10. During normal operation, compressed air or a similar pressure fluid is constantly supplied through both of pipes 35, 37.

Figures 7, 8:
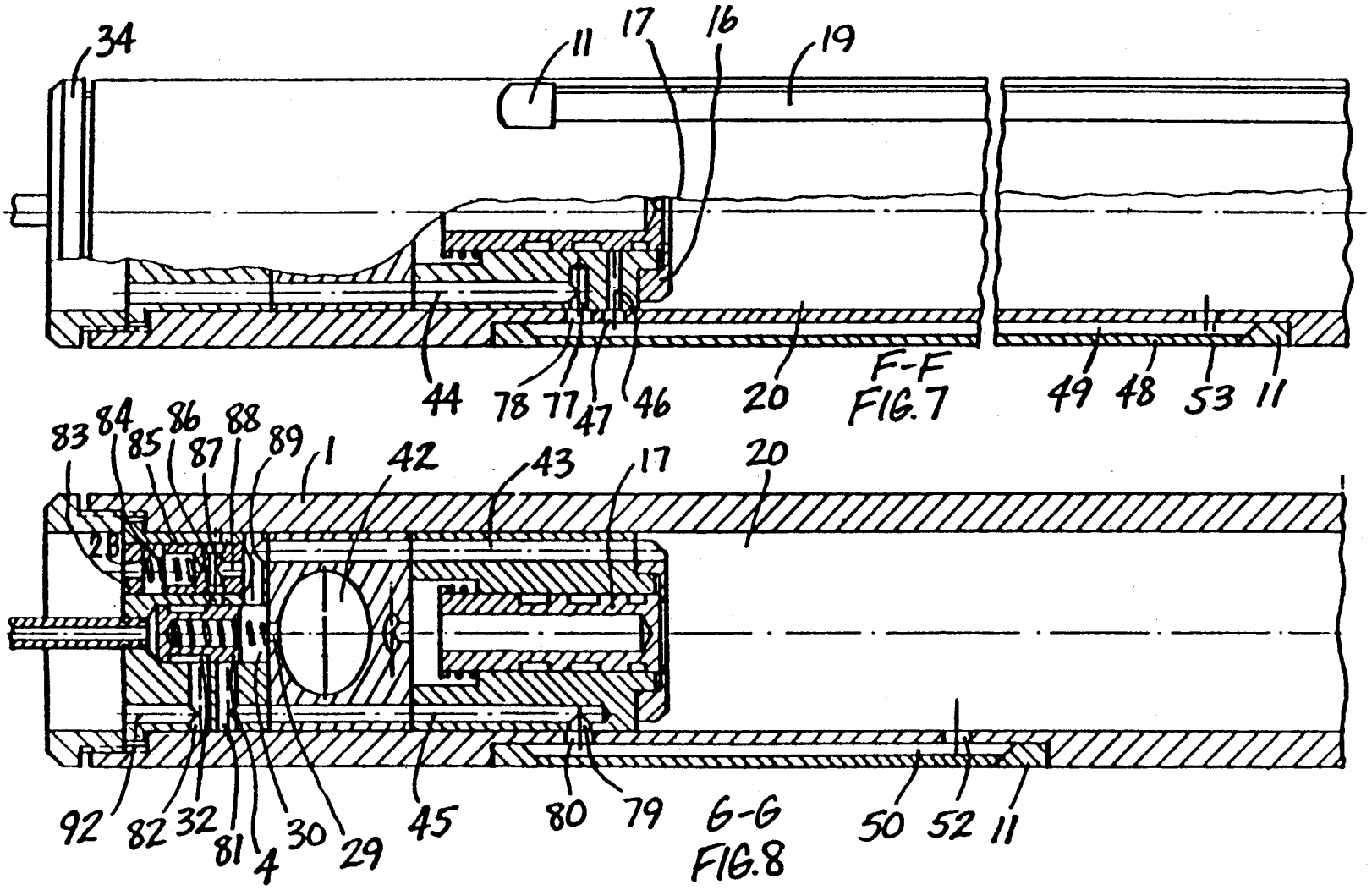
FIG. 7 is a partly broken away, longitudinal sectional view taken along the line F—F in FIG. 5.
FIG. 8 is a partial, longitudinal sectional view taken along the line G—G in FIG. 4, with the machine components positioned for forward mode operation.

Referring to FIGS. 8 and 10, pipe 36 supplies compressed air into a chamber 30 of the mode control system 205. Pipe 36 is constantly pressurized during reverse operation, and remains depressurized during forward operation. Chamber 30 in rear cylinder 2 communicates with passages 81, 82, 86, 29 and 89 for changing the operation of distibuting mechanism 203 and braking mechanism 204 as described hereafter. When no compressed air is supplied through pipe 36, a mode control valve 4 is biased to a left end position (FIG. 8) by a spring 31 confined between a rear wall of cylinder 5 and the bottom of a forwardly opening recess 4*a*. Valve 4 is biased to a right position when compressed air enters chamber 30 (FIG. 10). In this position the front cylindrical end of valve 4 interrupts communication between passages 29 and 89, and an annular groove 32 in the outer periphery of valve 4 permits communication between passages 81, 82, and 86.

Mode control system 205 further includes a cut-off valve 85 slidably secured in a rearwardly opening recess 2*b* in rear cylinder 2. A compression spring 84 confined between a vented plug 83 and a rearwardly opening recess in valve 85 resiliently biases valve 85 to a forward position as shown in FIGS. 8 and 10. A T-shaped passage 87, 88 in valve 85 allows communication between passages 86 and 89 when valve 85 is in its forward (extended) position.

Referring now to FIGS. 2, 8, 10 and 13, the cyclic action braking system 204 cooperates with the air distributing mechanism 203 to cyclically extend and retract a plurality of pins 27. Pins 27 extend radially outwardly from housing 1 (FIG. 13) during the forward stroke of striker 202 to engage the wall of the tunnel being formed in order to hold the machine body 201 against rearward movement (recoil) during forward movement of striker 202. For this purpose pins 27 are mounted in a cylindrical chamber 42 within cylinder 5, which chamber 42 is oriented transversely to the lengthwise direction of the machine. Cavity 42 communicates directly with forward stroke chamber 20 through passages 43, 89, 29 and chamber 30 when the machine is in forward mode. In reverse mode, valve 4 closes and isolates chamber 42 from chamber 20 (see FIG. 10).

Each pin 27 is slidably mounted in a bushing 38 which is screwed into a threaded opening 1*d* in housing 1. Each bushing 38 has an elastomeric (or plastic) front sealing ring 40 mounted in an internal annular groove 38*a* thereof which is in sealing contact with the exterior of pin 27 (see FIG. 2). A pair of radial inner and outer flanges 27*a*, 27*b* disposed at the rear of each pin 27 retain a rear sealing ring 39 similar to front ring 40 for sliding, sealed engagement with the wall of chamber 42. A compression spring 41 confined between flange 27*a* and the inner surface of bushing 38 biases each pin 27 towards the retracted position shown in FIG. 2.

Figure 17:
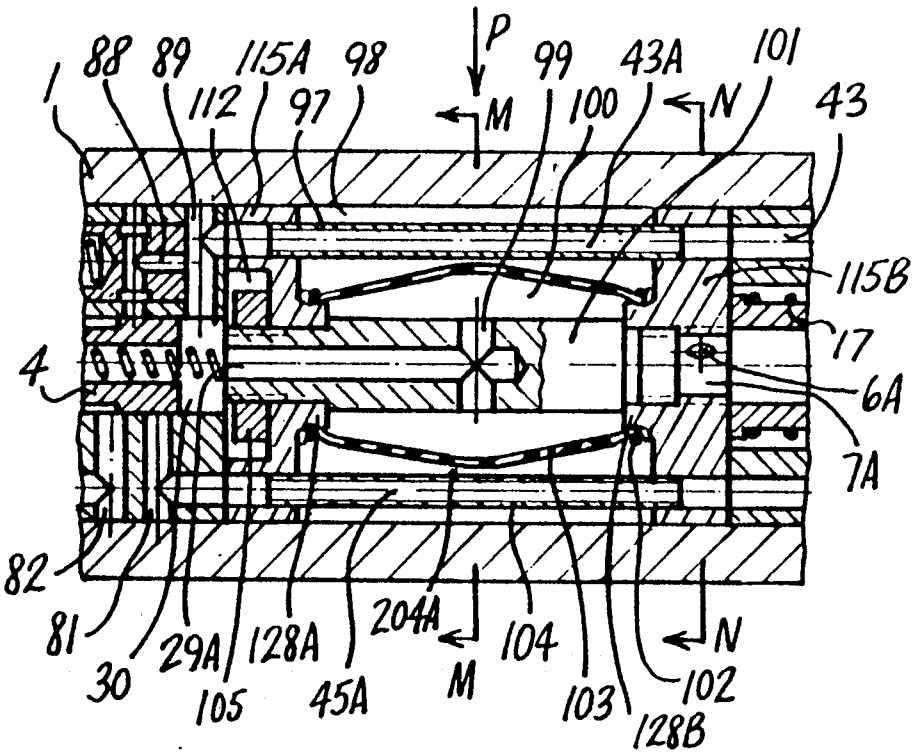
FIG. 17 is a partial, longitudinal sectional view of an embodiment of a braking mechanism according to the invention, taken at the same angle as FIG. 8. The components are positioned at the beginning of the forward stroke of the striker with the machine in forward made.

FIGS. 17-20 illustrate an alternative cyclical braking system 204A. In this embodiment pins 27 are replaced by blades 127. Cylinder 5 is replaced by a pair of front and rear end flanges 115*b*, 115*a* secured together by a turnbuckle 101 having internal passages 29*a*, 99 which communicate with chamber 30. A nut 105 disposed in a rearwardly opening recess 112 in rear flange 115*a* and threadedly coupled to a rear threaded end of turnbuckle 101 secures flange 115*a* to a step in turnbuckle 101 (FIG. 17). The ends of a tubular flexible diaphragm 103 are secured to inwardly directed, opposing, undercut projections 128*a*, 128*b* of flanges 115*a*, 115*b* by a pair of clips 102. In this manner air fed into the internal space 100 of diaphragm 103 from front stroke chamber 20 inflates diaphragm 103.

The front end of turnbuckle 105 and front flange 115*b* cooperate to define passages 6*a*, 7*a* (see FIG. 20) for feeding compressed air to chamber 8. Exterior space 98 (outside of diaphragm 103) cooperates with passages 44*a*, 44*b* to perform the function of passage 44 in the embodiment illustrated in FIG. 7. The other air flow passages 3*a*, 43*a*, 28*a*, and 45*a* which pass through flanges 115*a*, 115*b* are isolated from space 98 by respective pipes 113, 97, 116, and 104 spanning flanges 115*a*, 115*b*.

Figure 18:
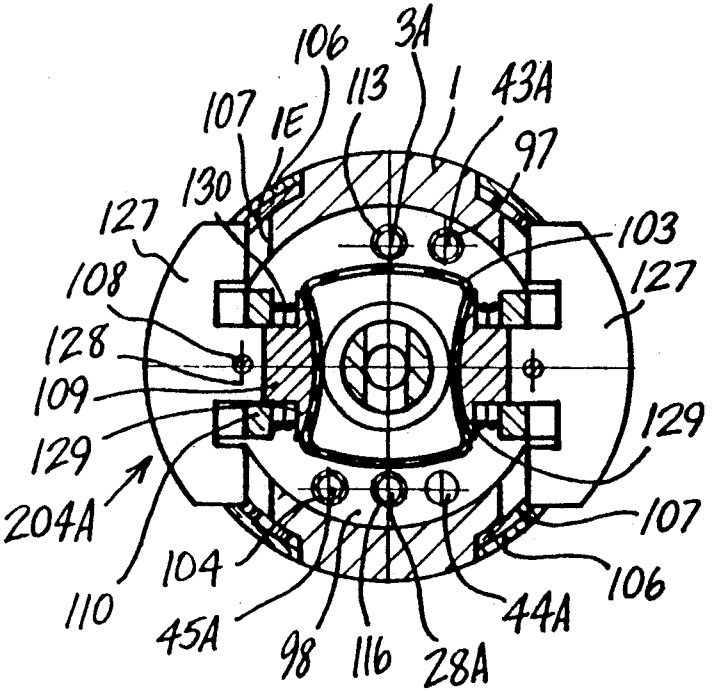
FIG. 18 is a cross-sectional view taken along the line M—M in FIG. 17, with braking blades extended.
Figure 20:
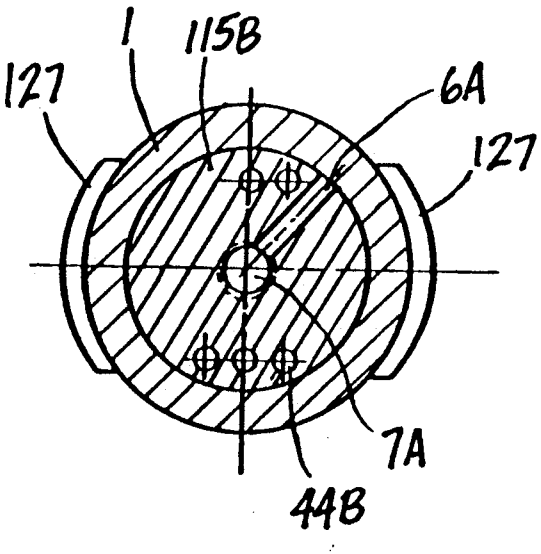
FIG. 20 is a cross-sectional view taken along the line N—N in FIG. 17.
Figure 19:
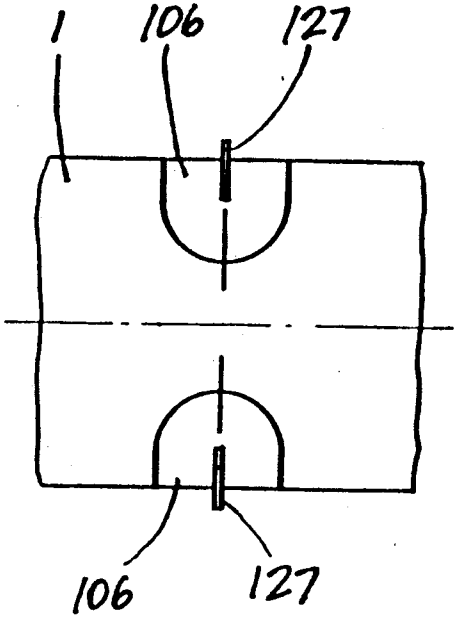
FIG. 19 is a partial, external view of the machine in the direction of the arrow P in FIG. 17.

Referring to FIGS. 18 and 19, each blade 127 includes a shank 128 slidably mounted on a guide plate 110 which is secured at its periphery (not shown) in an opening le in housing 1. Each plate 110 is secured by a cover 106 lined with a sealing material 107 which prevents dirt penetration around the blade 127. Cover 106 is secured by any suitable means, such as screws (not shown), to housing 1. Shank 128 is secured by a pin 108 to a push button 109 having an inner concave head and an annular flange 129. A spring 130 confined between flange 129 and the inside of plate 10 biases each blade 127 to a retracted position. Upon pressurization of inner space 100, diaphragm 103 engages each of buttons 109 and compresses springs 130 to extend blades 127 to the position shown in FIGS. 18-20.

Referring now to FIG. 14, a sensor 208 for monitoring the operation of machine 200 is, in the illustrated embodiment, a transducer comprising a magnetic core 93 coaxially disposed for axial movement inside a solenoid 94 secured to a modified plug 84*a*. Core 93 is attached directly to the rear of a modified cutoff valve 85*a* and oscillates in unison therewith. A wire 95 conducts current induced in solenoid 94 by the movement of core 93 to an external analyzer which provides the operator with a readout, e.g., a digital display that corresponds to the frequency of oscillation of valve 85. Valve 85 acts as an oscillator, i.e., it oscillates in tandem with striker 202, so that sensor 208 provides a continuous signal reflecting the state of operation of the machine.

When machine 200 is operating normally in forward mode, the signal from sensor 208 will remain within a normal range that can be empirically determined. However, when machine 200 strikes a large rock or similar impassable obstacle, the impact frequency of the striker 202 will be altered because the machine body no longer moves forward with each stroke, changing the stroke length and hence its frequency. To prevent machine 200 from deviating from its original course, the operator can then turn off the machine, or switch to reverse mode using mode control system 205.

Figure 21:
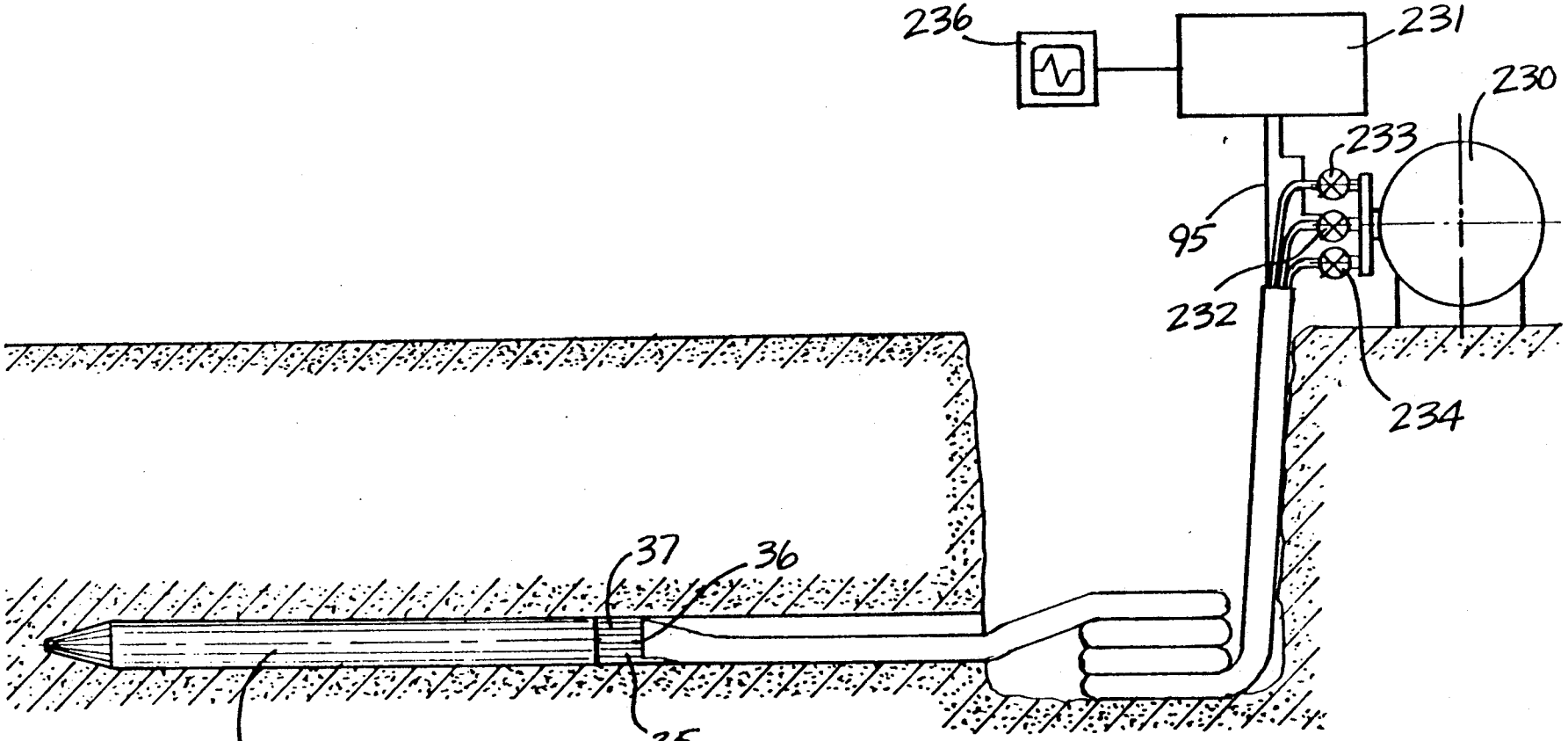
FIG. 21 is a schematic diagram of an automatic monitoring and mode switching system according to the invention.

As shown in FIG. 21, according to a further alternative embodiment of the invention, an air compressor 230 which powers machine 200 may be provided with a control unit 231, such as a programmable logic controller, which receives the signal from wire 95. Controller 231 responds to an abnormal frequency signal by actuating a control valve 232 that switches the machine to reverse mode. Controller 231 could also be connected to suitable valves 233, 234 for depressurizing both of lines 37, 35 to stop machine 200. This type of automated control system eliminates the possibility that the machine will become lost due to operator error. A display device, such as an oscilloscope 236, may be connected to controller 231 to provide a continuous display of the working state of the machine.

B. Assembly

Machine 200 according to the invention is assembled as follows. Cylinders 2, 5 and 10 containing most of the air distributing mechanism 203, cyclic-action braking mechanism 204, and mode control system 205 are rigidly connected to each other by fasteners (not shown) and inserted into the rear end of housing 1 or 1*a*. Then, braking pins 27 with sealing collars 39 and springs 41 are inserted through the corresponding openings 1*d*, and screw bushings 38 with sealing rings 40 are secured thereover. To prevent jamming of pins 27, longitudinal adjustments of the inserted parts may be made by insertion of shims 33. The inserted parts are then secured by the tail nut 34.

Striker 202 is then inserted into the housing or 1*a* through its front open end. Striker can also be inserted through the rear end of housing 1, if open, since housing 1 has the same inner diameter along substantially all its length. Chisel assembly 207 is then secured to the front end of the housing 1 or 1*a*. Elastic rings 69, 72, and 73 are preliminarily compressed, so that when the chisel 74 moves forward as a result of an impact, elastic link 72 expands and no longitudinal gap is created between components 70, 72, and 74.

Forward Mode Operation

In FIGS. 1*a*, 1*b*, machine 200 is shown at the beginning of the backward stroke of striker 202. Machine 200 will remain in this position so long as air supply line 37 of the forward stroke chamber 20 is pressurized, forcing valve 17 to its right end position, and supply line 35 is depressurized. Striker 202 can be brought to its front end position by pressurizing and depressurizing forward stroke air supply line 37 several times. To start machine 200 from this position, both of lines 35 and 37 are depressurized. Stroke control valve 17, under the action of spring 9, then moves to its left end position, so that it presses against cylinder 5 (see FIG. 9).

Forward stroke chamber air supply line 37 is then pressurized so that compressed air flows through passages 3, 6, and 7 (FIGS. 1*a* and 2) and enters chamber 8 and recess 26 of stroke control valve 17 (FIGS. 1*a* and 9). Such compressed air flows through holes 25, circular groove 24 and passages 90, 91 into forward stroke chamber 20, which is connected with the atmosphere through pasages 53, 49, 77, 78, and 44 (FIG. 7). The difference in pressure on opposite sides of control valve 17 then causes it to move to its right end position, at which it presses against rear anvil 16, compressing, spring 9. In this position, valve 17 overlaps holes 90, and compressed air cannot enter chamber 20, which is still open to the atmosphere.

Backward stroke air supply line 35 is then pressurized so that compressed air then flows through air passages 28, 23, circular groove 22, and passages 12, 13, 18, 64, and enters backward stroke chamber 75 (FIGS. 1*a*, 1*b*). Under the action of the compressed air striker 202 moves rearwardly, overlaping hole 53 and starting to build up an air buffer in chamber 20. Continued movement of striker 202 opens hole 53 and connects chamber 75 with the atmosphere. In chamber 20, the air pressure builds to a level at which the resulting force pushes valve 17 to its left end position.

In this position, valve 17 overlaps holes 13 and 23, so that the compressed air can no longer enter chamber 75, wherein the pressure drops to atmospheric pressure. As shown in FIG. 9, at this position of valve 17, passage 90 is open and chamber 20 is now connected with air supply line 37. Striker 202 is braked by the compressed air pressure in chamber 20 and stops before it reaches rear anvil 16. The forward stroke of striker 202 then begins.

Cyclic action braking mechanism 204 operates in tandem with striker 202. During the forward (penetrating) mode of operation, chamber 42 (FIG. 2) communicates by passages 43, 89, chamber 30, and passage 29 (FIGS. 2, 8, 10) with chamber 20, so that the pressure in chambers 20 and 42 is always the same. When these chambers are pressurized, pins 27 (FIG. 13) move out, penetrating the soil and braking housing 1 against rearward movement.

The second embodiment 204*a* of the cyclic action braking mechanism works similarly. As shown in FIG. 18, space 100 within diaphragm 103 is in constant communication with chamber 20. Blades 127 protract as chambers 20, 100 are pressurized, then retract under the action of springs 130 when chambers 20, 100 are depressurized.

During its forward stroke striker 202 overlaps hole 53. To avoid generating an air buffer in chamber 75 which would oppose forward movement of striker 202 and reduce the efficiency of machine 200, an additional air bypass connecting chamber 75 with the atmosphere during the forward stroke of striker is provided. When hole 53 is overlapped as striker 202 moves forward, air from chamber 75 is expelled to the atmosphere through passages 64, 18, 14, 15, as shown in FIGS. 1*a*, 1*b*, and then through groove 21 and passages 46, 47, 49, 78, 77, and 44 as shown in FIGS. 7, 12.

Near the end of the forward stroke, striker 202 opens hole 53. Chamber 20 is again open to the atmosphere, pins 27 are retracted by springs 41, and stroke control valve 17 moves to its right end (forward) position. At the end of the stroke, striker 202 imparts a blow to anvil 65. Chisel 74 instantly obtains an initial velocity, while striker 202 becomes motionless. This type of collision results in maximum transfer of kinetic energy from striker 202 to chisel 74.

Striker 202 becomes motionless after the collision only if the ratio of the mass of striker 202 to the mass of chisel 74 is equal to the magnitude of the restitution coefficient between these two masses. When the restitution coefficient is determined, then the mass of chisel 74 can be calculated by dividing the mass of striker 202 by the restitution coefficient. The mass of striker 202 is predetermined by energy aspects and design considerations. The optimium mass of chisel 74 can be obtained by changing the length of the cylindrical part of chisel 74. The striker/chisel weight ratio is typically from 0.65–0.7 for purposes of the present invention.

Chisel 74 starts to penetrate into the soil ahead of machine 200 and, by means of elastic rings 69, 72, 73, pulls forward housing 1 and all of the other components of the machine. Elastic rings 69, 72, 73 act as shock absorbers and greatly reduce the peak impact loads acting on the machine components located rearwardly of chisel 74. As a result, threaded connections can be used to connect components to housing 1 (e.g., nut 34 and adapter 70) without subjecting such connections to loads which might break the connections. This further allows housing 1 to be made from a drawn steel pipe rather than by machining a solid steel rod, resulting in a considerable cost reduction. Compressed air then begins to enter chamber 75, and the backward stroke of striker 202 begins again. Forward movement of machine 200 during one cycle of operation occurs over a very short time, much shorter than the cycle frequency of striker 202.

During forward operation, mode control valve 4 is held in its left end position by spring 31 (FIGS. 1*a*, 8, and 14). In this position, passage 89 is open and passage 81 is overlapped. Cut-off valve 85 is always connected with the forward stroke chamber 20 through passages 43, 89, 88. When the pressure in chamber 20 increases, valve 85 moves to the left, and when the pressure in chamber 20 drops, valve 85 is returned to the right by spring 84. Thus, valve 85 reciprocates during operation of machine 200. In the embodiment of FIG. 14, cut-off valve 85*a* reciprocates and an electrical current is induced in solenoid 94 and transmitted through wire 95 to the analyzer, e.g., controller 231 and display device 26 (FIG. 21). The operator thereby obtains current information about the performance of the machine.

D. Reverse Mode Operation

To change the mode of operation of machine 200, the operator opens a three-way valve to pressurize line 36. Control valve 4 moves to its right end position, overlapping passage 89 and connecting passages 81 and 82 by circular groove 32 (FIGS. 8, 10, and 14). Passage 86 also communicates with circular groove 32.

With mode control valve 4 in this position, cyclic action braking mechanism 204 is inoperative, since it is not needed for effective reverse machine movement. Forward stroke chamber 20 is now open to the atmosphere through hole 52, passages 50, 79, 80, 45, 81, circular groove 32, and passages 82, 92 (FIG. 10). When forward stroke chamber 20 is opened to the atmosphere, stroke control valve 17 moves to its right end position, and compressed air enters into backward stroke chamber 75.

Striker 202 then moves rearwardly, gaining kinetic energy. When hole 52 is overlapped by striker 202, chamber 20 is still connected with the atmosphere by passages 43, 89, calibrated hole 88, passages 87, 86, circular groove 32, and passages 82, 92. In this manner, valve 85 prevents an air buffer from being generated during the backward stroke of the striker 202, which imparts a blow at the end of its backward stroke to the rear anvil 16. Housing 1 thereby obtains a velocity in the retracting direction. Before sleeve 56 touches rear anvil 16, valve tappet 54 pushes the stroke control valve 17 to the left (FIG. 11). Valve tappet 54 and holder 58 are preloaded to the right by spring 62, protecting stroke control valve 17 from excessive impact loading.

With stroke control valve 17 in its left end position, compressed air enters chamber 20 through holes 25, circular groove 24, and passages 90, 91 (FIGS. 9, 11). From chamber 20 compressed air passes to cut-off valve 85 through passages 43, 89 (FIG. 10). Passage 88 in valve 85 is a calibrated hole having a predetermined cross-sectional area such that passage 88 is not capable of relieving the high-pressure compressed air to the atmosphere, but is capable of relieving the lower air buffer pressure when striker 202 was moving rearwardly, as described above. By this means, cut-off valve 85 under pressure of the compressed air moves to its left end position and overlaps passage 86, which was previously open to the atmosphere with mode control valve 4 in the right end position. Chamber 20 is thereby no longer open to the atmosphere.

Stroke control valve 17 remains in its left end position because spring 9 presses it to the left, the air pressure from both sides being equal. The forward stroke of striker 202 then begins. However, the stroke length of the striker is significantly shortened because hole 52 is open to the atmosphere. When striker 202 opens hole 52, the air pressure in chamber 20 drops, stroke control valve 17 moves to the right, and compressed air begins to enter into backward stroke chamber 75. Hole 53 is then overlapped by striker 202, and the forward motion of striker 202 is braked by the compressed air in chamber 75. Striker 202 stops without reaching front anvil 65, and the backward stroke of striker 202 begins. Forward stroke chamber 20 is connected with the atmosphere, and cut-off valve 85, under the action of spring 84, moves to its right end position, opening chamber 20 to the atmosphere even after striker 202, moving to the left, overlaps hole 52. The cycle then repeats itself.

E. Alternative Embodiments

A variety of changes could be made in the described construction and different embodiments of the present invention can be made without departing from the scope of the invention as expressed in the claims. For example, the cyclic action braking mechanism may simply constitute an expandable rubber diaphragm which engages the tunnel wall instead of pins or blades. The cyclic action braking mechanism can also be conventiently repositioned so that it follows behind the body of the tool. Various aspects of the invention can be used in conjunction with other types of air distributing and reversing mechanisms.

Figure 22:
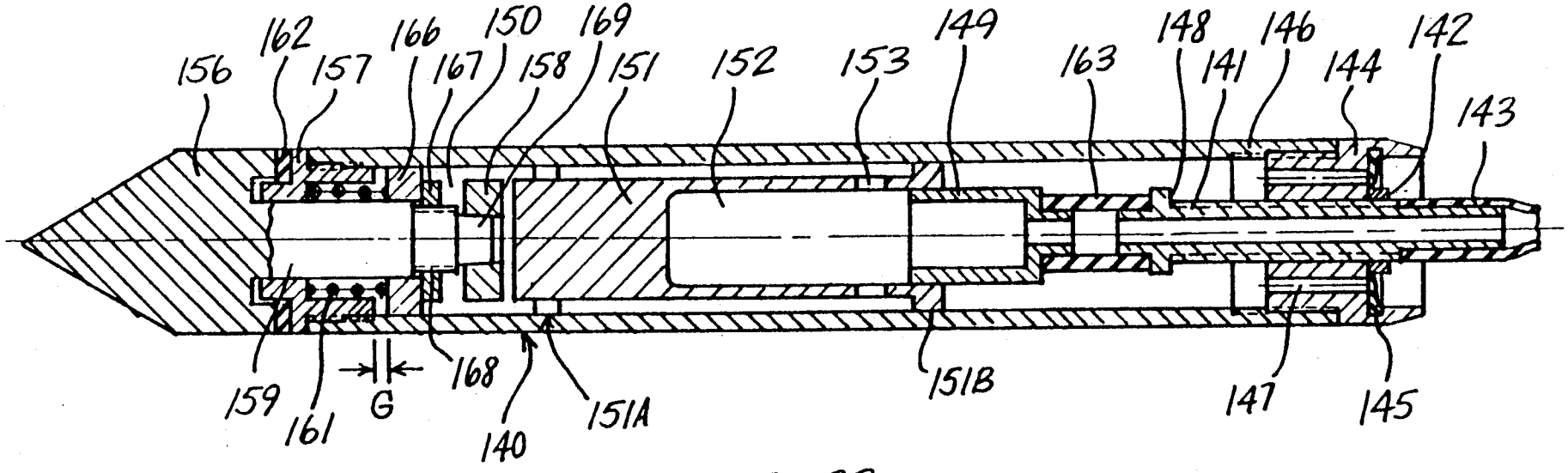
FIG. 22 is a lengthwise sectional view of an alternative embodiment of a machine having a movable chisel according to the invention.

FIG. 22 illustrates a reversible machine 140 having a stepped bushing type of air distributing mechanism. The rear end of an air inlet pipe 141 is coupled to a compressed air supply hose 143. A tailpiece 144 is threadedly secured in the rear end of a tubular machine housing 146. A plurality of exhaust passages 147 extend lengthwise through tailpiece 144 for conducting spent compressed air to the atmosphere. A threaded outer surface along the midsection of pipe 141 is threadedly, coaxially secured in an associated threaded hole of tailpiece 144 to provide a screw reverse mechanism. Relative rotation of pipe 141 relative to tailpiece 144 is limited to a front end position by a radial flange 148 on pipe 141, and to a rear end position by a nut 142 threadly secured to pipe 141 at the rear of its threaded midsection. A flapper valve 145 mounted on tailpiece 144 rearwardly of exhaust passages 147 prevents foreign matter from entering the machine through passages 147.

The enlarged diameter front end of a stepped tubular bushing 149 slidingly engages a rearwardly opening cylindrical recess 152 in a striker 151 to provide a constant pressure chamber for propelling striker 151 forward. Step bushing 149 is coupled to pipe 141 by suitable means, such as an elastic pipe 163. In the alternative, stepped bushing 149 and pipe 141 can be formed as a single member. Radial ports 153 in the wall of the striker surrounding recess 152 provide for the rearward stroke of the striker in a manner well known in the art, i.e., compressed air passes into a front, variable volume chamber 150 to propel striker 151 rearwardly. Striker 151 is slidably supported on the interior surface of housing 146 by front and rear bearing surfaces 151A, 151B. Rear bearing surface 151B is annular and sealingly engages the inner surface of housing 146, whereas front bearings 151A include air passages for allowing compressed air to pass therethrough to force striker 151 rearwardly when front chamber 150 is pressurized.

Striker 151 impacts against a ring-shaped rear anvil 158 which is seated on a cone-shaped rear end 169 of a movable chisel 156. Chisel 156 is movably secured in the open front end of tubular housing 146 by an adapter 157. The resulting shock is transmitted through a resilient spring 161 and resilient gasket 162 to the housing 146. Annular gasket 162 is loaded under compression between a tapered head 160 of chisel 156 and adapter 157. Gasket 162 expands during forward movement of chisel 156 to prevent particles of soil from jamming chisel 156.

Spring 161 is a coil spring in the illustrated embodiment, but other types of springs could be employed. Spring 161 is coaxially disposed around an elongated central shank 159 of chisel 156 and is confined for compression between adapter 157 and a ring 166. Ring 166 is slidably mounted on the inner surface of housing 146 and the outer surface of shank 159 near the rear end thereof. An adjustment nut 167 is threadedly secured behind ring 166 to a rear, reduced diameter threaded portion 168 of shank 159. Spring 161 urges ring 166 into abutment with nut 167. Nut 167 can be adjusted to vary the gap G, i.e., the maximum distance chisel 156 can move at each impact.

The masses of striker 151 and chisel 156 are preferably selected to maximize the amount of kinetic energy transferred, as described above. The resulting machine 140 is of simple construction, improved efficiency, and eliminates the need to provide a shock absorber in the tail assembly of the machine for protecting the various threaded connections.

I claim:

1. A pneumopercussive soil penetrating machine, comprising:

an elongated housing;

a chisel assembly secured to the front end of said housing, including a movable chisel, means for slidably supporting said chisel for lengthwise movement over a predetermined distance, and a resilient shock absorber disposed to transmit kinetic energy from said chisel to said housing as said chisel moves forward;

a striker disposed for lengthwise reciprocation in said housing for impacting against said chisel;

an air distributing mechanism connectable to a supply of compressed air for reciprocating said striker within said housing; and means for preventing soil from entering behind said chisel by expanding to fill a gap between the outer surface of said chisel and the outer surface of said housing when said chisel moves forwardly relative to said housing over the entire range of movement of said chisel relative to said housing.

2. The machine of claim 1, wherein said chisel supporting means comprises a generally tubular adapter secured in a front end opening of said housing, and said chisel comprises a forwardly tapering head which has substantially the same diameter as said housing at a rear edge of said head, a shank extending rearwardly from said head through said adapter, and an enlarged diameter anvil within said housing at the rear end of said shank behind said adapter positioned to receive impacts from said striker.

3. The machine of claim 2, wherein said preventing means comprises a resilient gasket confined under compression between said head and said adapter.

4. The machine of claim 1, further comprising a mode control system for selectively changing the mode of operation of said striker to and from a forward mode in which said striker impacts against said chisel to drive said machine forward, and a rearward mode in which said striker impacts against a rear impact surface to drive said machine rearward.

5. The machine of claim 1, wherein said preventing means comprises a gasket.

6. The machine of claim 5, wherein said gasket is made of an elastomeric material and is fitted between said chisel and said housing under compression.

7. The machine of claim 6, wherein said gasket is annular.

8. A reversible, pneumopercussive soil penetrating machine, comprising:

an elongated body including a tubular housing and a frontwardly tapering nose;

a striker disposed for lengthwise reciprocation in said housing for impacting against a front interior impact surface thereof;

an air distributing mechanism connectable to a supply of compressed air for reciprocating said striker within said housing, and a mode control system for selectively changing the mode of operation of said air distributing mechanism from a forward mode in which said striker impacts against said front impact surface to drive said machine forward, and a rearward mode in which said striker impacts against a rear impact surface to drive said machine rearward, including a valve which cooperates with said air distributing mechanism to selectively open an exhaust passage proximate the rear end of a chamber within said housing in which said striker moves, which passage is positioned to alter the flow of compressed air within the air distributing mechanism to shorten the forward stroke of the striker when the striker moves forwardly in said chamber by the action of compressed air and uncovers said exhaust passage, and relieve pressure in the portion of said chamber behind said striker during rearward movement of said striker so that the striker impacts on a rear anvil surface at the rear of said chamber to provide rearward mode operation.

9. The machine of claim 8, further comprising a compressed air supply line which actuates said valve by supplying compressed air thereto.

10. The machine of claim 9, wherein said valve moves in response to compressed air fed thereto through said supply line to a first position for causing one of said modes of operation, and said mode control system further comprises a spring for biasing said valve to a second position for causing the other of said modes of operation absent compressed air pressure in said supply line.

11. The machine of claim 8, further comprising a control device remote from said machine body including a compressed air supply hose which actuates said valve by supplying compressed air thereto.

12. The machine of claim 11, wherein said control device comprises a valve near the end of said hose remote from said machine body for regulating the supply of compressed air in said supply line.

13. A pneumopercussive soil penetrating machine, comprising:

an elongated body including a tubular housing and a frontwardly tapering nose;

a striker disposed for lengthwise reciprocation in said housing for impacting against a front interior impact surface thereof; and an air distributing mechanism connectable to a supply of compressed air for reciprocating said striker within said housing, including a first series of passages in communication with a first compressed air supply line, a second series of passages in communication with a second compressed air supply line, and a stroke control valve having associated air flow passages which stroke control valve moves between a forward stroke position and a rearward stroke position for alternately establishing communication between a forward stroke chamber located behind said striker with said first compressed air supply line during the forward stroke of the striker, and a rearward stroke chamber located ahead of said striker with said second compressed air supply line during the rearward stroke of the striker.

14. The machine of claim 13, wherein said first and second supply lines are separately connected by hoses to respective control valves located on a source of compressed air.

15. The machine of claim 13, further comprising a mode control system for selectively changing the mode of operation of said air distributing mechanism from a forward mode in which said striker impacts against said front impact surface to drive said machine forward, and a rearward mode in which said machine impacts against a rear impact surface to drive said machine rearward.

16. The machine of claim 15, wherein said strike control valve is slidably mounted in a bore at the rear of said forward stroke chamber for movement in the lengthwise direction of said housing, and said striker at the end of its rearward stroke during rearward mode operation pushes said strike control valve into said forward stroke position.

17. The machine of claim 16, wherein said striker has a tappet mounted for sliding lengthwise movement extending rearwardly from said striker for engagement with said stroke control valve, and resilient means for biasing said tappet to a rearwardmost extending position.

18. The machine of claim 13, wherein said air distributing mechanism further comprises means for relieving air buffer pressure in said rearward stroke chamber as said striker moves forwardly towards said front impact surface.

19. A pneumopercussive machine for forming a tunnel through soil by compaction, comprising:

an elongated body including a tubular housing and a frontwardly tapering nose;

a stroker disposed for lengthwise reciprocation in said housing for impacting against a front interior impact surface thereof;

an air distributing mechanism connectable to a supply of compressed air for reciprocating said striker within said housing; and a cyclic action braking system which alternately engages a wall of the tunnel being formed to hinder rearward movement of said body and disengages the tunnel wall during forward movement of said body, including a projection and means for alternately extending said projection outwardly from said body to engage said tunnel wall and retracting said projection out of contact with said tunnel wall just prior to impact of said striker on said front impact surface.

20. The machine of claim 19, wherein said braking system includes a series of projections disposed in openings in said housing.

21. The machine of claim 19, wherein said braking system further comprises passage means in communication with the interior of said housing rearwardly of said striker for allowing pressurized air in a forward stroke chamber behind said striker to actuate said braking system and extend said projection as long as said forward stroke chamber remains pressurized.

22. The machine of claim 21, wherein said braking system further comprises a spring which biases said projection to a retracted position when said forward stroke chamber is depressurized.

23. A reversible, pneumopercussive soil penetrating machine, comprising:

an elongated body including a tubular housing and a frontwardly tapering nose;

a striker disposed for lengthwise reciprocation in said housing for impacting against said chisel, said striker including a generally cylindrical body, a rear impact hammer mounted on said striker body for sliding lengthwise movement relative to said striker body, and a shock absorber interposed between said striker body and said rear impact hammer;

an air distributing mechanism connectable to a supply of compressed air for reciprocating said striker within said housing; and a mode control system for selectively changing the mode of operation of said striker to and from a forward mode in which said striker impacts against a front impact surface of said body to drive said machine forward, and a rearward mode in which said rear impact hammer of said striker impacts against a rear impact surface to drive said machine rearward and said shock absorber dampens the shock resulting from the rearward momentum of said striker body.

24. The method of claim 23, wherein an automated control system carries out steps (B) and (C).

25. A pneumopercussive machine for forming a tunnel through soil by compaction, comprising:

an elongated boy including a tubular housing and a frontwardly tapering nose;

a striker disposed for lengthwise reciprocation in a chamber in said housing for impacting against a front interior impact surface housing;

an air distributing mechanism connectable to a supply of compressed air for reciprocating said striker within said housing; and a transducer responsive to changes in pressure in said chamber for monitoring the stroke frequency of said 26. The machine of claim 25, wherein said transducer further comprises an oscillator disposed in communication with said air distributing mechanism to oscillate in tandem with the reciprocations of said striker, means for converting oscillations of said oscillator into electrical signals and means for transmitting said signals from said machine to a remote analyzer.

27. The machine of claim 26, wherein said transducer comprises a magnetic core secured to said oscillator for movement therewith and a solenoid disposed around said core, and said means for transmitting said signals comprises a wire secured to said solenoid.

28. A method for operating a reversible pneumopercussive machine to form a tunnel through soil by compaction, which machine comprises an elongated body including a tubular housing and a frontwardly tapering nose, a striker disposed for lengthwise reciprocation in said housing for impacting against a front interior impact surface thereof, an air distributing mechanism connectable to a supply of compressed air for reciprocating said striker within said housing, a sensor for monitoring the stroke frequency of said striker, and a mode control system for selectively changing the mode of operation of said air distributing mechanism between a forward mode in which said striker impacts against said front impact surface to drive said machine forward, and a rearward mode in which said machine impacts against a rear impact surface to drive said machine rearward, which method comprises the steps of:

(A) operating said machine in forward mode to progressively form a tunnel through the ground at a preselected site;

(B) monitoring the impact frequency of said machine during said forward mode operating step as indicated by said sensor; and (C) ceasing forward operation of said machine when said impact frequency varies outside of a predetermined normal range for forward mode operation.

29. The method of claim 28, wherein said step (C) further comprises actuating said mode control system to switch said machine to reverse mode and withdraw said machine from said tunnel.

30. A pneumopercussive soil penetrating machine, comprising:

an elongated housing;

a chisel assembly secured to the front end of said housing, including a movable chisel, an adapter secured to said housing for slidably supporting said chisel for lengthwise movement over a predetermined distance, a resilient spring disposed to transmit kinetic energy from said chisel through said adapter to said housing as said chisel moves forward, and a resilient gasket confined between said chisel and said adapter for preventing soil from entering behind said chisel by expanding to fill a gap between the outer surface of said chisel and the outer surface of said housing when said chisel moves forwardly relative to said housing over the entire range of movement of said chisel relative to said housing;

a striker supported on front and rear bearing surfaces for lengthwise sliding reciprocation in said housing for impacting against said chisel, said striker having a rearwardly opening recess therein and a radial hole therethrough communicating with said recess ahead of said rear bearing surface;

a tailpiece secured in a rear opening of said housing, said tailpiece having exhaust passages therethrough and a central threaded hole; and an air distributing mechanism connectable to a supply of compressed air for reciprocating said striker within said housing, including an air inlet pipe coaxially secured in said central threaded hole of said tailpiece, a tubular stepped bushing which communicates with said air inlet pipe and has an enlarged diameter front end portion which is slidably, sealingly mounted in said recess in said striker, and flexible means for securing said stepped bushing to said air inlet pipe.

31. A pneumopercussive soil penetrating machine, comprising:

an elongated housing;

a chisel assembly secured to the front end of said housing, including a movable chisel, means for slidably supporting said chisel for lengthwise movement over a predetermined distance, and means for transmitting kinetic energy from said chisel to said housing as said chisel moves forward;

a striker disposed for lengthwise reciprocation in said housing for impacting against said chisel; and an air distributing mechanism connectable to a supply of compressed air for reciprocating said striker within said housing;

wherein the magnitude of the ratio of the mass of said striker to the mass of said chisel is substantially equal to the magnitude of the restitution coefficient for a collision between said striker and said chisel.

32. In a pneumopercussive soil penetrating machine, including an elongated body including a tubular housing and a frontwardly tapering nose, a striker disposed for lengthwise reciprocation within a chamber in said housing for impacting against a front interior impact surface thereof, and an air distributing mechanism connectable to a supply of compressed air for reciprocating said striker within said housing, the improvement which comprises:

means for preventing build-up of an air buffer ahead of the striker during the forward stroke of the striker by relieving pressure in said chamber ahead of the striker to the atmosphere.

33. The machine of claim 32, wherein said preventing means comprises:

a passage in said housing for allowing communication between the front end of said chamber and the atmosphere for allowing pressure relief in the portion of said chamber ahead of the striker during the forward stroke of the striker;

a valve positioned to open and close said passage; and means for closing said valve during the rearward stroke of said striker when the portion of said chamber ahead of said striker is pressurized and opening said valve during forward movement of said striker.

34. A reversible, pneumopercussive soil penetrating machine, comprising:

an elongated body including a tubular housing and a frontwardly tapering nose;

a striker disposed for lengthwise reciprocation is said housing for impacting against a front interior impact surface thereof;

an air distributing mechanism connectable to a supply of compressed air for reciprocating said striker within said housing, including a stroke control valve having associated air flow passages, which stroke control valve moves between a forward stroke position and a rearward stroke position to alternately establish communication between a forward stroke chamber located behind said striker with said first compressed air supply line during the forward stroke of the striker, and a rearward stroke chamber located ahead of said striker with said second compressed air supply line during the rearward stroke of the striker; and a mode control system for selectively changing the mode of operation of said air distributing mechanism from a forward mode in which said striker impacts against said front impact surface to drive said machine forward, and a rearward mode in which said striker impacts against a rear impact surface to drive said machine rearward, including a mode control valve which cooperates with said air distributing mechanism to switch from one mode to the other, and means for actuating said mode control valve while said machine is in operation and without changing the position of said stroke control valve.

35. The machine of claim 34, further comprising a cyclic action braking system which alternately engages a wall of the tunnel being formed to hinder rearward movement of said body and disengages the tunnel wall during forward movement of said body, including a projection and means for alternately extending said projections to engage said tunnel wall and retracting said projection out of contact with said tunnel wall just prior to impact of said striker on said front impact surface, said extending means including a passage communicating with said forward stroke chamber for extending said projection in response to pressurized air from said forward stroke chamber, said mode control valve closing said passage to deactive said braking system when said tool is in rearward mode.

36. A reversible, pneumopercussive sol penetrating machine, comprising:

an elongated body including a tubular housing and a frontwardly tapering nose;

a striker disposed for lengthwise reciprocation within a chamber in said housing for impacting against a front interior impact surface thereof;

an air distributing mechanism connectable to a supply of compressed air for reciprocating said striker within said housing, including a stroke control valve having associated air flow passages for alternately feeding compressed air to the back of said chamber behind said striker when said stroke control valve is in a first position, and to the front of said chamber ahead of the strike when said stroke control valve is in a second position, including a first exhaust passage allowing communication between the atmosphere and said chamber at a position between the middle of said chamber and the front thereof; and a mode control system for selectively changing the mode of operation of said air distributing mechanism from a forward mode in which said striker impacts against said front impact surface to drive said machine forward, and a rearward mode in which said striker impacts against a rear impact surface to drive said machine rearward, including a second exhaust passage allowing communication between the atmosphere and said chamber at a position between the middle of said chamber and the rear thereof, the opening of said second exhaust passage being spaced from the opening of said first exhaust passage, and means for opening said second passage when said machine is in rearward mode and closing said second passage when said machine is in forward mode.

37. A reversible, pneumopercussive soil penetrating machine, comprising:

an elongated, tubular housing having front and rear openings;

a chisel assembly mounted in said front opening in said housing, including a movable chisel, means for slidably supporting said chisel on said housing for lengthwise movement over a predetermined distance, and a resilient shock absorber disposed to transmit kinetic energy from said chisel to said housing as said chisel moves forward;

a striker disposed for lengthwise reciprocation in said housing for impacting against said chisel, said striker including a generally cylindrical body, a rear impact hammer mounted on said striker body for sliding lengthwise movement relative to said striker body, and a shock absorber interposed between said striker body and said rear impact hammer;

an air distributing mechanism connectable to a supply of compressed air for reciprocating said striker within said housing, including a first series of passages in communication with a first compressed air supply line, a second series of passages in communication with a second compressed air supply line, and a stroke control valve having associated air flow passages for alternately establishing communication between a forward stroke chamber located behind said striker with said first compressed air supply line, and a rearward stroke chamber located ahead of said striker with said second compressed air supply line;

a mode control system for selectively changing the mode of operation of said air distributing mechanism from a forward mode in which said striker impacts against said front impact surface to drive said machine forward, and a rearward mode in which said striker impacts against a rear impact surface to drive said machine rearward, so that the shock absorber in said striker dampens the shock resulting from the rearward momentum of said striker body, including a valve body which cooperates with said air distributing mechanism to alternate compressed air flow therethrough between a first series of passages configured to provide forward mode operation and a second series of passages configured to provide rearward mode operation; and a cyclic action braking system including a plurality of projections disposed to protrude to engage a wall of the tunnel being formed to hinder rearward movement of said body and retract to disengage the tunnel wall during forward movement of said body, and means responsive to compressed air from said first compressed air supply line for alternately extending said projections to engage said tunnel wall and retracting said projections out of contact with said tunnel wall just prior to impact of said striker on said front impact surface.

38. A reversible, pneumopercussive soil penetrating machine, comprising:

an elongated, tubular housing having front and rear openings and a plurality of lengthwise, inwardly opening air flow passages formed therein;

a chisel assembly mounted in said front opening in said housing, including a movable chisel, means for slidably supporting said chisel on said housing for lengthwise movement over a predetermined distance, and a resilient member disposed to transmit kinetic energy from said chisel to said housing on said chisel moves forward;

a striker disposed for lengthwise reciprocation in said housing for impacting against said chisel, said striker including a generally cylindrical body, a rear impact hammer mounted on said striker body for sliding lengthwise movement relative to said striker body, and a shock absorber for dampening rearward impacts of said rear hammer;

an air distributing mechanism connectable to a supply of compressed air for reciprocating said striker within said housing, including:

a cylinder mounted in the rear end opening of said housing, said cylinder having a frontwardly opening bore and a rear chamber;

a stroke control valve slidably mounted in the frontwardly opening bore of said cylinder, said stroke control valve having separate forward and rearward stroke valve passages therein;

means for resiliently biasing said stroke control valve to a rearwardmost position;

means for limiting lengthwise sliding movement of said stroke control valve to a forwardmost position;

a first compressed air supply line for supplying air to drive said striker forward;

a second compressed air supply line for supplying air to drive said striker rearward;

a third compressed air supply line for supplying air to said rear chamber in said cylinder to switch the tool between forward and reverse modes of operation;

a first forward stroke passage for conducting compressed air from said first air supply line to said frontwardly opening bore in said cylinder to a position where compressed air from said first forward stroke passage enters said forward stroke valve passage when said valve is in one of its endmost positions;

a second forward stroke passage aligned with said first forward stroke passage for conducting compressed air from said forward stroke valve passage in said stroke control valve to a forward stroke chamber between the rear of the striker and the interior of said housing to propel said striker forwardly;

a first rearward stroke passage in said cylinder for conducting compressed air from said second air supply line to said frontwardly opening bore to a position where compressed air from said first rearward stroke passage enters said rearward stroke valve passage when said valve is the other of its endmost positions;

a second rearward stroke passage in said cylinder aligned with said first rearward stroke passage for conducting compressed air from said second passage of said stroke control valve to a first one of said lengthwise passages in said housing, said first passage in said housing opening near the front of a rearward stroke chamber between the front of said striker and the interior of said housing to propel said striker rearwardly when said stroke control valve is in position to supply compressed air to said second rearward stroke passage;

means including a first exhaust passage in said housing and said cylinder for allowing the rearward stroke chamber and communicate with the atmosphere during the forward stroke of the striker; and a second exhaust passage in said housing and said cylinder for allowing the forward stroke chamber to communicate with the atmosphere during a middle part of the rearward stroke of the striker and for allowing depressurization of said rearward stroke chamber during an intermediate part of the rearward stroke of the striker;

a mode control system for selectively changing the mode of operation of said air distributing mechanism from a forward mode in which said striker impacts against said front impact surface to drive said machine forward, and a rearward mode in which said striker impacts against a rear impact surface to drive said machine rearward, so that the shock absorber in said striker dampens the shock resulting from the rearward momentum of said striker body, including:

a mode control valve disposed in said rear chamber in said cylinder having an air flow passage therein;

means for biasing said mode control valve to an endmost position;

a passage for admitting compressed air from said third compressed air supply line to force said mode control valve to a second endmost position against the force of said mode control valve biasing means;

a third exhaust passage in said housing, said cylinder and including said passage in said mode control valve, for allowing the forward stroke chamber to communicate with the atmosphere during the last part of rearward stroke of the striker when said stroke control valve is in one of its endmost positions; and a cyclic action braking system which alternately engages a wall of the tunnel being formed to hinder rearward movement of said body and disengages the tunnel wall during forward movement of said body, said braking system including projections disposed in openings in said housing, and means responsive to compressed air from said first compressed air supply line for alternately extending said projections to engage said tunnel wall and retracting said projections out of contact with said tunnel wall just prior to impact of said striker on said front impact surface.

39. The machine of claim 38, wherein said forward and rearward stroke passage in said stroke control valve comprise annular grooves forward in the exterior surface thereof at axially spaced positions.

40. The machine of claim 38, wherein said stroke control valve comprise a cylinder having a rear radial flange, and said biasing means comprises a spring confined between a front surface of said flange and a rearwardly facing internal wall of said cylinder.

41. The machine of claim 38, wherein said cylinder of said air distributing mechanism comprises a plurality of cylindrical sections, and means for rigidly coupling said sections together end-to-end.

42. The machine of claim 41, wherein the rearwardmost one of said cylindrical sections has a rear annular flange, and said rear opening of said housing has an internal counterbore therein, such that said rear annular flange of said rear cylindrical section is received in said counterbore and limits insertion of said cylinder of said air distributing mechanism.

43. The machine of claim 41, wherein said housing further comprises a threaded tail nut which is received in mating threads formed on the interior periphery of said rear opening of said housing in said counterbore, so that said tail nut clamps said rear annular flange of said rear cylindrical section to said housing.

44. The machine of clam 38, wherein said means including said first exhaust passage further comprises an exhaust passage in said stroke control valve which opens said first exhaust passage during the forward stroke of said striker and opens said first exhaust passage during the rearward stroke of said striker.

* * * * *